US009784005B2

(12) United States Patent
Richardson et al.

(10) Patent No.: US 9,784,005 B2
(45) Date of Patent: Oct. 10, 2017

(54) SYSTEMS FOR RESTORING, REPAIRING, REINFORCING, PROTECTING, INSULATING AND/OR CLADDING STRUCTURES WITH LOCATABLE STAND-OFF COMPONENTS

(71) Applicant: CFS Concrete Forming Systems Inc., Vancouver (CA)

(72) Inventors: George David Richardson, Vancouver (CA); Semion Krivulin, Richmond (CA); Zi Li Fang, New Westminster (CA)

(73) Assignee: CFS Concrete Forming Systems Inc., Vancouver, British Columbia (CA)

( * ) Notice: Subject to any disclaimer, the term of this patent is extended or adjusted under 35 U.S.C. 154(b) by 0 days.

(21) Appl. No.: 15/063,189

(22) Filed: Mar. 7, 2016

(65) Prior Publication Data

US 2016/0186452 A1 Jun. 30, 2016

Related U.S. Application Data

(63) Continuation of application No. 14/368,773, filed as application No. PCT/CA2013/050005 on Jan. 4, 2013, now Pat. No. 9,315,987.

(Continued)

(51) Int. Cl.
*E04G 23/02* (2006.01)
*E04B 2/86* (2006.01)

(52) U.S. Cl.
CPC ..... *E04G 23/0218* (2013.01); *E04B 2/8641* (2013.01); *E04B 2/8635* (2013.01)

(58) Field of Classification Search
CPC .. E04B 2/8641; E04B 2/8635; E04G 23/0218

(Continued)

(56) References Cited

U.S. PATENT DOCUMENTS 154,179 A 8/1874 Hubert
374,826 A 12/1887 Clarke (Continued)

FOREIGN PATENT DOCUMENTS

CA 0574720 4/1959
CA 0957816 11/1974

(Continued)

OTHER PUBLICATIONS

Vector Corrosion Technologies Marketing Materials, 2005.

(Continued)

*Primary Examiner* — Paola Agudelo
(74) *Attorney, Agent, or Firm* — Todd A. Rattray; Oyen Wiggs Green & Mutala LLP

(57) ABSTRACT

Apparatus covering at least a portion of a surface of an existing structure with a repair structure comprise: a plurality of longitudinally and transversely extending panels connected to one another in edge-adjacent relationship; and a plurality of standoffs connected to the panels and extending from the panels toward the existing structure. Each panel comprises a panel connector component which extends longitudinally along the panel and from an interior surface of the panel toward the existing structure, and each standoff comprises a standoff connector component complementary to the panel connector component. The connector components are shaped such that a connection formed therebetween comprises deformation of at least one of the panel connector component and the standoff connector component and creates corresponding restorative deformation forces that prevent relative movement between the panel and the standoff under the force of gravity.

20 Claims, 17 Drawing Sheets

Related U.S. Application Data

(60) Provisional application No. 61/583,589, filed on Jan. 5, 2012, provisional application No. 61/703,169, filed on Sep. 19, 2012.

(58) Field of Classification Search
USPC ..... 52/514, 514.5, 834
See application file for complete search history.

(56) References Cited

U.S. PATENT DOCUMENTS 510,720 A 12/1893 Stewart, Jr.
820,246 A 5/1906 Nidds
999,334 A 8/1911 Pearson
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,063,122 A 11/1962 Katz
3,100,677 A 8/1963 Frank et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,321,884 A 5/1967 Klaue
3,468,088 A 9/1969 Miller
3,545,152 A 12/1970 Knohl
3,555,751 A 1/1971 Thorgusen
3,588,027 A 6/1971 Bowden
3,682,434 A 8/1972 Boenig
3,769,769 A 11/1973 Kohl
3,788,020 A 1/1974 Gregori
3,822,557 A * 7/1974 Frederick ..... E02D 5/08 405/248
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,114,388 A 9/1978 Straub
4,180,956 A 1/1980 Gross
4,182,087 A 1/1980 Schall et al.
4,193,243 A 3/1980 Tiner
4,276,730 A 7/1981 Lewis
4,299,070 A 11/1981 Ottmanns et al.
4,332,119 A 6/1982 Toews
4,351,870 A 9/1982 English
4,383,674 A 5/1983 Fricker
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,664,560 A 5/1987 Cortlever
4,695,033 A 9/1987 Imaeda et al.
4,703,602 A 11/1987 Pardo
4,731,964 A 3/1988 Phillips
4,731,971 A 3/1988 Terkl
4,742,665 A 5/1988 Baierl
4,808,039 A * 2/1989 Fischer ..... E02D 19/18 405/129.8
4,856,754 A 8/1989 Yokota et al.
4,866,891 A * 9/1989 Young ..... E04B 2/8641 52/105
4,930,282 A 6/1990 Meadows
4,946,056 A 8/1990 Stannard
4,995,191 A 2/1991 Davis
5,014,480 A 5/1991 Guarriello et al.
5,028,368 A 7/1991 Grau
5,058,855 A 10/1991 Ward
5,078,360 A 1/1992 Spera
5,106,233 A * 4/1992 Breaux ..... B09B 1/008 405/129.8
5,124,102 A 6/1992 Serafini
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley
5,292,208 A * 3/1994 Berger ..... E02D 5/12 405/274
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,714,045 A 2/1998 Lasa et al.
5,729,944 A 3/1998 De Zen
5,740,648 A 4/1998 Piccone
5,747,134 A 5/1998 Mohammed et al.
5,791,103 A 8/1998 Coolman
5,824,347 A 10/1998 Serafini
5,860,262 A 1/1999 Johnson
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.
6,185,884 B1 2/2001 Myers et al.
6,189,269 B1 2/2001 De Zen
6,212,845 B1 4/2001 De Zen
6,219,984 B1 4/2001 Piccone
6,220,779 B1 4/2001 Warner et al.
6,247,280 B1 * 6/2001 Grinshpun ..... E04B 2/8635 52/309.12
6,286,281 B1 9/2001 Johnson
6,293,067 B1 9/2001 Meendering et al.
6,357,196 B1 3/2002 McCombs

(56) References Cited

U.S. PATENT DOCUMENTS

| | | | | |
|---|---|---|---|---|
| 6,387,309 | B1 | 5/2002 | Kojima | |
| 6,405,508 | B1 | 6/2002 | Janesky | |
| 6,435,470 | B1 | 8/2002 | Lahham et al. | |
| 6,435,471 | B1 | 8/2002 | Piccone | |
| 6,438,918 | B2 | 8/2002 | Moore et al. | |
| 6,467,136 | B1 | 10/2002 | Graham | |
| 6,530,185 | B1 | 3/2003 | Scott et al. | |
| 6,550,194 | B2 | 4/2003 | Jackson et al. | |
| 6,588,165 | B1 | 7/2003 | Wright | |
| 6,622,452 | B2 | 9/2003 | Alvaro | |
| 6,691,976 | B2 | 2/2004 | Myers et al. | |
| 6,694,692 | B2 | 2/2004 | Piccone | |
| 6,832,456 | B1 | 12/2004 | Bilowol | |
| 6,866,445 | B2 | 3/2005 | Semler | |
| 6,935,081 | B2 | 8/2005 | Dunn et al. | |
| 7,320,201 | B2 | 1/2008 | Kitchen et al. | |
| 7,444,788 | B2 | 11/2008 | Morin et al. | |
| 7,818,936 | B2 | 10/2010 | Morin et al. | |
| 8,074,418 | B2 | 12/2011 | Thiagarajan et al. | |
| 8,485,493 | B2 | 7/2013 | Wells et al. | |
| 8,707,648 | B2 | 4/2014 | Timko et al. | |
| 8,769,904 | B1 | 7/2014 | Brandt et al. | |
| 8,806,839 | B2 * | 8/2014 | Zhou | B28B 19/00 52/742.14 |
| 8,881,483 | B2 | 11/2014 | Caboni | |
| 8,959,871 | B2 | 2/2015 | Parenti et al. | |
| 2003/0005659 | A1 | 1/2003 | Moore, Jr. | |
| 2003/0085482 | A1 | 5/2003 | Sincock et al. | |
| 2003/0155683 | A1 | 8/2003 | Pietrobon | |
| 2004/0010994 | A1 | 1/2004 | Piccone | |
| 2004/0020149 | A1 | 2/2004 | Messiqua | |
| 2004/0093817 | A1 | 5/2004 | Pujol Barcons | |
| 2004/0216408 | A1 | 11/2004 | Hohmann, Jr. | |
| 2005/0016083 | A1 | 1/2005 | Morin et al. | |
| 2005/0016103 | A1 * | 1/2005 | Piccone | E04B 2/8641 52/481.1 |
| 2006/0179762 | A1 | 8/2006 | Thome et al. | |
| 2006/0185270 | A1 | 8/2006 | Handley et al. | |
| 2006/0213140 | A1 | 9/2006 | Morin et al. | |
| 2007/0028544 | A1 | 2/2007 | Messiqua et al. | |
| 2007/0107341 | A1 | 5/2007 | Zhu | |
| 2007/0193169 | A1 | 8/2007 | Emblin | |
| 2008/0168734 | A1 | 7/2008 | Degen et al. | |
| 2009/0120027 | A1 | 5/2009 | Amend | |
| 2009/0229214 | A1 | 9/2009 | Nelson | |
| 2009/0269130 | A1 | 10/2009 | Williams | |
| 2010/0047608 | A1 | 2/2010 | Seccombe | |
| 2010/0050552 | A1 | 3/2010 | David | |
| 2010/0071304 | A1 | 3/2010 | Richardson et al. | |
| 2010/0251657 | A1 | 10/2010 | Richardson et al. | |
| 2010/0325984 | A1 | 12/2010 | Richardson et al. | |
| 2011/0000161 | A1 * | 1/2011 | Aube | E04B 2/46 52/563 |
| 2011/0099932 | A1 | 5/2011 | Saulce | |
| 2011/0131914 | A1 * | 6/2011 | Richardson | E04G 23/02 52/514.5 |
| 2011/0277410 | A1 * | 11/2011 | Richardson | E04G 23/0218 52/426 |
| 2012/0056344 | A1 | 3/2012 | Richardson et al. | |
| 2013/0081345 | A1 | 4/2013 | Sheehy | |

FOREIGN PATENT DOCUMENTS

| | | |
|---|---|---|
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2716118 | 8/2008 |
| CA | 2681963 | 10/2008 |
| CA | 2751134 | 12/2011 |
| CA | 2855742 | 5/2013 |
| CH | 317758 | 1/1957 |
| CH | 669235 | 2/1989 |
| CN | 2529936 | 1/2003 |
| DE | 1684357 | 4/1967 |
| DE | 1812590 | 6/1970 |
| DE | 2062723 | 8/1972 |
| DE | 3003446 | 8/1981 |
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0179046 | 4/1986 |
| EP | 0757137 | 2/1997 |
| EP | 2169133 | 3/2010 |
| FR | 0507787 | 7/1920 |
| FR | 1381945 | 11/1964 |
| FR | 1603005 | 4/1971 |
| FR | 2364314 | 4/1978 |
| FR | 2535417 | 5/1984 |
| FR | 2721054 | 6/1994 |
| FR | 2717848 | 9/1995 |
| FR | 2669364 | 3/2012 |
| GB | 137221 | 1/1920 |
| GB | 779916 | 7/1957 |
| GB | 1243173 | 8/1971 |
| GB | 1253447 | 11/1971 |
| GB | 2141661 | 1/1985 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2005040526 | 5/2005 |
| WO | 2008119178 | 10/2008 |
| WO | 2009059410 | 5/2009 |
| WO | 2009092158 | 7/2009 |
| WO | 2010012061 | 2/2010 |
| WO | 2010037211 | 4/2010 |
| WO | 2010078645 | 7/2010 |
| WO | 2010094111 A1 | 8/2010 |

OTHER PUBLICATIONS

Vector Corrosion Technologies Marketing Materials, 2007.

Vector Corrosion Technologies Marketing Materials, 2008.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

The Digigraph System, http://www.digigraph-housing.com/web/system.ht, accessed online Jan. 2012.

* cited by examiner

SYSTEMS FOR RESTORING, REPAIRING, REINFORCING, PROTECTING, INSULATING AND/OR CLADDING STRUCTURES WITH LOCATABLE STAND-OFF COMPONENTS

REFERENCE TO RELATED APPLICATIONS

This application is a continuation of U.S. application Ser. No. 14/368,773 having a 371 date of 25 Jun. 2014 which in turn is a national entry of PCT application No. PCT/CA2013/050005 having an international filing date of 4 Jan. 2013, which in turn claims priority (and the benefit of 35 USC 119(e)) from U.S. application No. 61/583,589 filed 5 Jan. 2012 and U.S. application No. 61/703,169 filed 19 Sep. 2012. All of the applications and patents referred to in this paragraph are hereby incorporated herein by reference.

TECHNICAL FIELD

The application relates to methods and apparatus (systems) for restoring, repairing, reinforcing, protecting, insulating and/or cladding a variety of structures. Some embodiments provide formworks (or portions thereof) for containing concrete or other curable material(s) until such curable materials are permitted to cure. Some embodiments provide claddings (or portions thereof) which line interior surfaces of other supportive formworks and which are anchored to curable materials as they are permitted to cure.

BACKGROUND

Concrete is used to construct a variety of structures, such as building walls and floors, bridge supports, dams, columns, raised platforms and the like. Typically, concrete structures are formed using embedded reinforcement bars (often referred to as rebar) or similar steel reinforcement material, which provides the resultant structure with increased strength. Over time, corrosion of the embedded reinforcement material can impair the integrity of the embedded reinforcement material, the surrounding concrete and the overall structure. Similar degradation of structural integrity can occur with or without corrosion over sufficiently long periods of time, in structures subject to large forces, in structures deployed in harsh environments, in structures coming into contact with destructive materials or the like.

FIG. 1A shows a cross-sectional view of an exemplary damaged structure 10. In the exemplary illustration, structure 10 is a column, although generally structure 10 may comprise any suitable structure. The column of structure 10 is generally rectangular in cross-section and extends vertically (i.e. into and out of the page in the FIG. 1A view). Structure 10 includes a portion 12 having a surface 14 that is damaged in regions 16A and 16B (collectively, damaged regions 16). The damage to structure 10 has changed the cross-sectional shape of portion 12 (and surface 14) in damaged regions 16. In damaged region 16A, rebar 18 is exposed.

FIG. 1B shows a cross-sectional view of another exemplary damaged structure 110. In the exemplary illustration, structure 110 is a column, although generally structure 10 may comprise any suitable structure. The column of structure 110 is generally round in cross-section and extends in the vertical direction (i.e. into and out of the page in the FIG. 1B view). Structure 110 includes a portion 112 having a surface 114 that is damaged in region 116.

There is a desire for methods and apparatus for repairing and/or restoring existing structures (or portions thereof) which have been degraded or which are otherwise in need of repair and/or restoration.

Some structures have been fabricated with inferior or sub-standard structural integrity. By way of non-limiting example, some older structures may have been fabricated in accordance with seismic engineering specifications that are lower than, or otherwise lack conformity with, current structural (e.g. seismic) engineering standards. There is a desire to reinforce existing structures (or portions thereof) to upgrade their structural integrity or other aspects thereof.

There is also a desire to protect existing structures from damage which may be caused by, or related to, the environments in which the existing structures are deployed and/or the materials which come into contact with the existing structures. By way of non-limiting example, structures fabricated from metal or concrete can be damaged when they are deployed in environments that are in or near salt water or in environments where the structures are exposed to salt or other chemicals used to de-ice roads.

There is also a desire to insulate existing structures (or portions thereof)—e.g. to minimize heat transfer across (and/or into and out of) the structure. There is also a general desire to clad existing structures (or portions thereof) using suitable cladding materials. Such cladding materials may help to repair, restore, reinforce, protect and/or insulate the existing structure.

Previously known techniques for repairing, restoring, reinforcing, protecting, insulating and/or cladding existing structures often use excessive amounts of material and are correspondingly expensive to implement. In some previously known techniques, unduly large amounts of material are used to provide standoff components and/or anchoring components, causing corresponding expense. There is a general desire to repair, restore, reinforce, protect, insulate and/or clad existing structures (or portions thereof) using a suitably small amount of material, so as to minimize expense.

The desire to repair, restore, reinforce, protect, insulate and/or clad existing structures (or portions thereof) is not limited to concrete structures. There are similar desires for existing structures fabricated from other materials.

The foregoing examples of the related art and limitations related thereto are intended to be illustrative and not exclusive. Other limitations of the related art will become apparent to those of skill in the art upon a reading of the specification and a study of the drawings.

SUMMARY

One aspect of the invention provides an apparatus for repairing an existing structure to cover at least a portion of a surface of the existing structure with a repair structure. The apparatus comprises: a plurality of longitudinally and transversely extending panels connected to one another in edge-adjacent relationship; and a plurality of standoffs connected to the panels and extending from the panels toward the existing structure. Each panel comprises an exterior surface and an opposing interior surface on a side of the panel closer to the existing structure. Each panel comprises a panel connector component which extends longitudinally along the panel and from the interior surface toward the existing structure. Each standoff comprises a standoff connector component which is complementary to the panel connector components. The panel connector components and standoff connector components are shaped such that a connection formed between each panel connector component and each corresponding standoff connector component involves deformation of at least one of the connector components and the creation of restorative deformation forces such that the restorative deformation forces prevent relative movement between the panels and the standoffs under the force of gravity. Curable material is introduced into a space between the interior surface of the panels and the existing structure and permitted to cure to provide a repair structure cladded at least in part by the panels. Extension of the standoffs into the space into which the curable material is introduced anchors the panels to the curable material as it cures to provide the cladding.

Another aspect of the invention provides a method for repairing an existing structure to cover at least a portion of a surface of the existing structure with a repair structure. The method comprises: connecting a plurality of longitudinally and transversely extending panels to one another in edge-adjacent relationship; connecting a plurality of standoffs to the panels such that the standoffs extend from the panels toward the existing structure; and introducing a curable material into a space between the panels and the existing structure and permitting the curable material to cure to provide a repair structure cladded at least in part by the panels. Connecting the plurality of standoffs to the panels comprises making a connection between a panel connector component of each panel and a corresponding standoff connector component of each standoff which involves deforming at least one of the connector components and creating restorative deformation forces such that the restorative deformation forces prevent relative movement between the panels and the standoffs under the force of gravity. Extension of the standoffs into the space into which the curable material is introduced anchors the panels to the curable material as it cures to provide the cladding.

Another aspect of the invention provides an apparatus for cladding a structure to cover at least a portion of a surface of the structure with a cladding. The apparatus comprises: a plurality of longitudinally and transversely extending panels connected to one another in edge-adjacent relationship and positioned such that the exterior surfaces of the edge-adjacent panels line at least a portion of an interior surface of a removable formwork; and a plurality of standoffs connected to the panels and extending from the panels toward an interior of the formwork. Each panel comprises a panel connector component which extends longitudinally along the panel and from the interior surface of the panel toward an interior of the formwork. Each standoff comprises a standoff connector component which is complementary to the panel connector components. The panel connector components and standoff connector components are shaped such that a connection formed between each panel connector component and each corresponding standoff connector component involves deformation of at least one of the connector components and the creation of restorative deformation forces such that the restorative deformation forces prevent relative movement between the panels and the standoffs under the force of gravity. Curable material is introduced into an interior of the formwork and permitted to cure to provide the structure cladded at least in part by the panels. Extension of the standoffs into the interior of the formwork where the curable material is introduced anchors the panels to the curable material as it cures to provide the cladding.

Another aspect of the invention provides a method for cladding a structure to cover at least a portion of a surface of the structure with a cladding. The method comprises: connecting a plurality of longitudinally and transversely extending panels to one another in edge-adjacent relationship; positioning the panels such that the exterior surfaces of the edge-adjacent panels line at least a portion of an interior surface of a removable formwork; connecting a plurality of standoffs to the panels such that the standoffs extend from the panels toward an interior of the formwork; introducing a curable material into the interior of the formwork; and permitting the curable material to cure to provide a repair structure cladded at least in part by the panels. Connecting the plurality of standoffs to the panels comprises making a connection between a panel connector component of each panel and a corresponding standoff connector component of each standoff which involves deforming at least one of the connector components and creating restorative deformation forces such that the restorative deformation forces prevent relative movement between the panels and the standoffs under the force of gravity. Extension of the standoffs into the interior of the formwork where the curable material is introduced anchors the panels to the curable material as it cures to provide the cladding.

Another aspect of the invention provides a standoff comprising an elongated shaft and a resiliently deformable connector component coupled to a connector end of the elongated shaft. The connector component is for creating restorative deformation forces between the connector component and a corresponding panel connector on the panel, the deformation forces preventing relative movement between the standoff and the panel due to gravity.

Aspects of the invention also provide repair structures and cladded structures fabricated using the methods and apparatus (systems) described herein. Kits may also be provided in accordance with some aspects of the invention. Such kits may comprise portions of the apparatus according to various embodiments and may facilitate effecting one or more methods according to various embodiments.

BRIEF DESCRIPTION OF DRAWINGS

Exemplary embodiments are illustrated in referenced figures of the drawings. It is intended that the embodiments and figures disclosed herein are to be considered illustrative rather than restrictive.

In drawings which illustrate non-limiting embodiments.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Apparatus and methods according to various embodiments may be used to repair, restore, reinforce, protect, insulate and/or clad existing structures. Some embodiments provide stay-in-place formworks (or portions thereof) or the like for containing concrete and/or similar curable materials until such curable materials are permitted to cure. Such formworks may optionally be reinforced by suitable bracing. Some embodiments provide claddings (or portions thereof) which line interior surfaces of other supportive and/or removable formworks and which are anchored to curable materials as such curable materials are permitted to cure. For brevity, in this disclosure (including any accompanying claims), apparatus and methods according to various embodiments may be described as being used to "repair" existing structures. In this context, the verb "to repair" and its various derivatives should be understood to have a broad meaning which may include, without limitation, to restore, to reinforce and/or to protect the existing structure. In some applications, which will be evident to those skilled in the art, the verb "to repair" and its various derivatives may additionally or alternatively be understood to include, without limitation, to insulate and/or to clad the existing structure.

Similarly, structures added to existing structures in accordance with particular embodiments of the invention may be referred to in this description (and any accompanying aspects or claims, if present) as "repair structures". However, such "repair structures" should be understood in a broad context to include additive structures which may, without limitation, repair, restore, reinforce and/or protect existing structures. In some applications, which will be evident to those skilled in the art, such "repair structures" may be understood to include structures which may, without limitation, insulate and/or clad existing structures. Further, some of the existing structures shown and described herein exhibit damaged regions which may be repaired in accordance with particular embodiments of the invention. In general, however, it is not necessary that existing structures be damaged and the methods and apparatus of particular aspects of the invention may be used to repair, restore, reinforce or protect existing structures which may be damaged or undamaged. Similarly, in some applications, which will be evident to those skilled in the art, methods and apparatus of particular aspects of the invention may be understood to insulate and/or clad existing structures which may be damaged or undamaged.

Figure 1A:
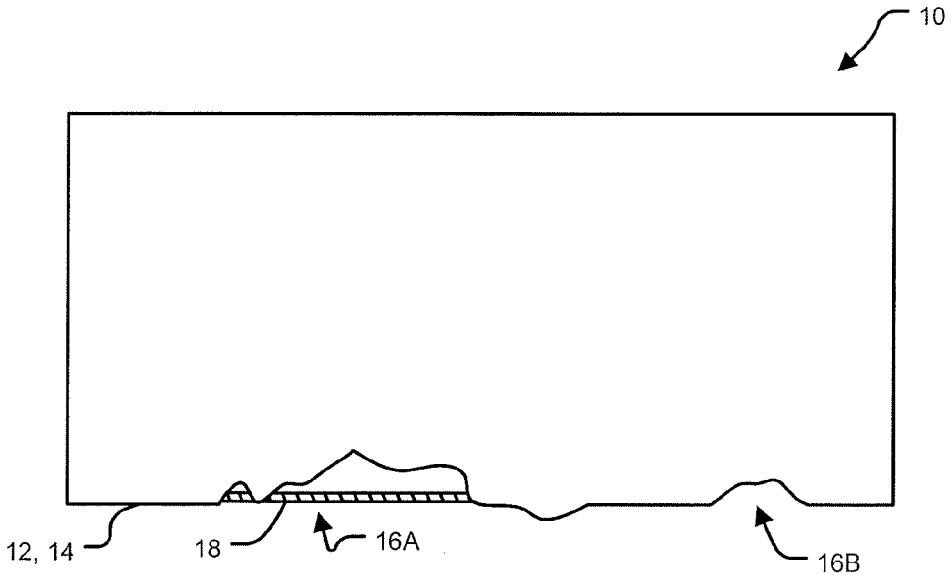
FIGS. 1A and 1B are cross-sectional views of existing structures which exhibit damaged regions.
Figure 2A:
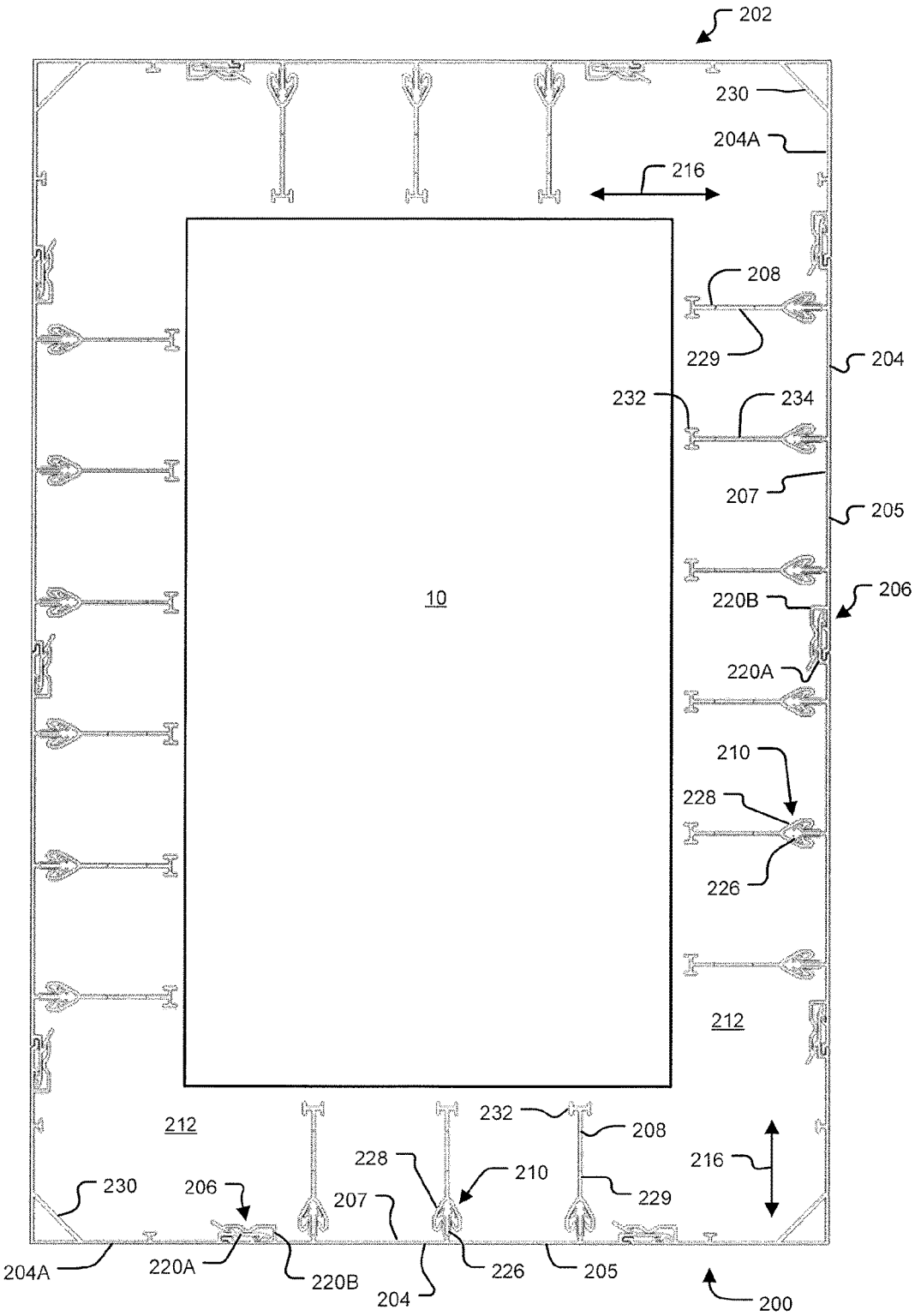
FIGS. 2A and 2B are respectively cross-sectional plan and cross-sectional isometric views of a system for building a repair structure and thereby repairing the FIG. 1A existing structure according to an example embodiment.
Figure 2B:
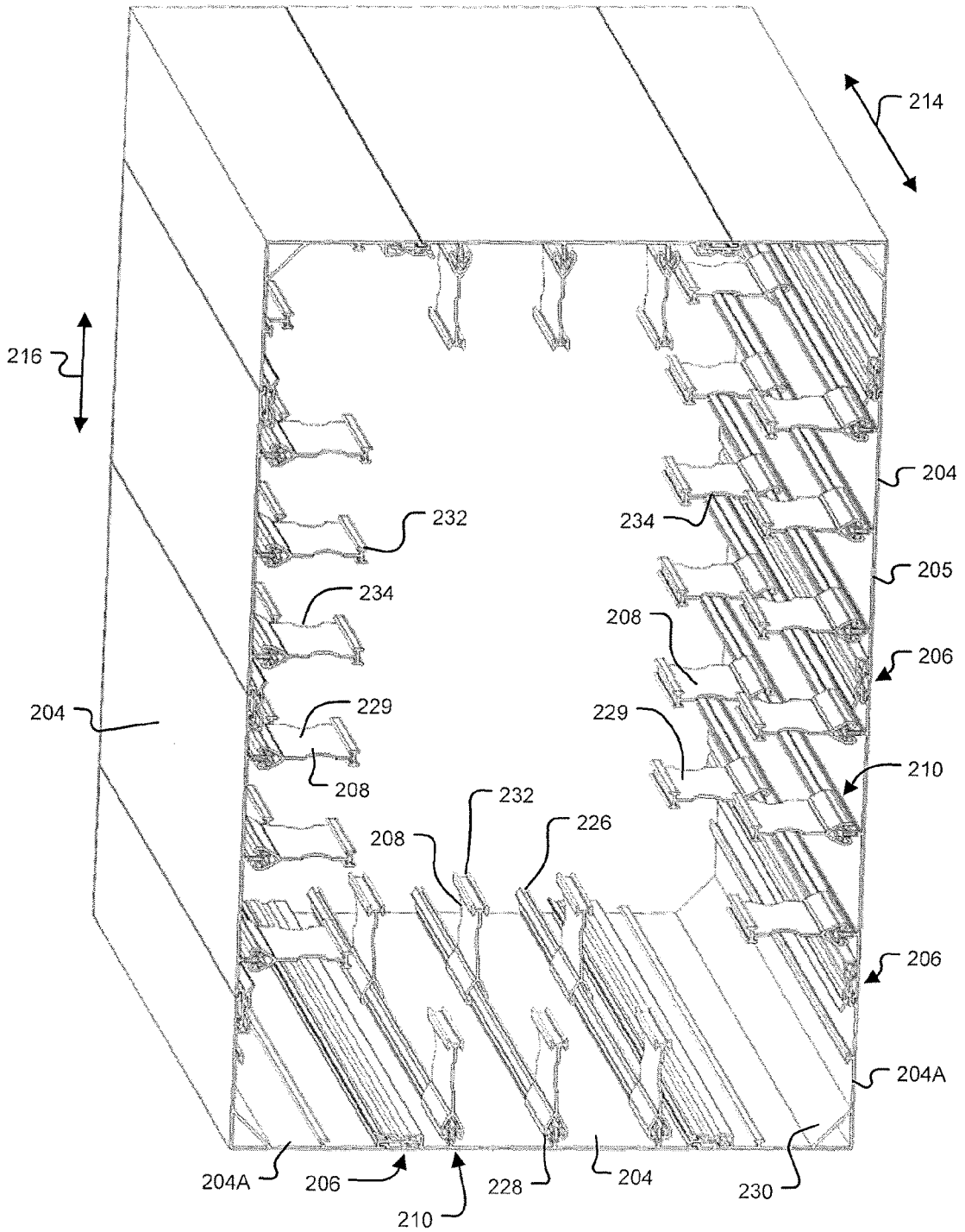

FIGS. 2A and 2B are respectively cross-sectional plan and cross-sectional isometric views of a system 200 for building a repair structure 202 and thereby repairing existing structure 10 (FIG. 1A) according to an example embodiment. For simplicity, existing structure 10 is not shown in FIG. 2B and damaged regions 16 of existing structure 10 are not shown in FIG. 2A. System 200 comprises: a plurality of panels 204 connected to one another in edge-adjacent relationship by connections 206; and a plurality of standoffs 208 connected to panels 204 (at connections 210) and extending from interior surfaces 207 of panels 204 toward existing structure 10. Panels 204 extend in a longitudinal direction 214 (into and out of the page in FIG. 2A) and in transverse directions 216 (in the plane of the page in FIG. 2A) to provide exterior surfaces 205 and interior surfaces 207. In some embodiments, the extension of panels 204 in longitudinal direction 214 and transverse direction 216 means that panels 204 are much wider and longer than they are thick (e.g. the width and/or length are more than 10 times the width). In these embodiments panels 204 form a relatively thin cladding for repair structure 202. In the illustrated embodiment, system 200 also comprises a plurality of outside corner panels 204A which extend in longitudinal direction 214 and in a pair of transverse directions 216 to conform to the general shape of existing structure 10 and which connect to a pair of panels 204 at connections 206. Repair structure 202 is formed when concrete (or some other curable material) is introduced into a space 212 between panels 204 and existing structure 10. Extension of standoffs 208 into space 212 anchors panels 204 to the curable material as it cures, thereby providing repair structure 202 with a cladding.

While not shown in the illustrated embodiment, repair structure 202 may comprise rebar which may be placed in space 212 prior to the introduction of curable material. In some embodiments, panels 204 provide at least a portion of the formwork needed to contain the curable material in space 212 until it cures. In some embodiments, panels 204 may optionally be braced by external bracing (not shown) which may assist panels 204 to contain the curable material in space 212. In some embodiments, panels 204 may provide a cladding which lines the interior of an external formwork (not shown) and the external formwork may provide the strength to contain the curable material in space 212 until it cures.

Panels 204 of the illustrated embodiment are generally planar in shape and may have generally uniform cross-sections in the direction of their longitudinal 214 dimensions, although this is not necessary. In some embodiments, the longitudinal 214 dimensions of panels 204 may be fabricated to have arbitrary lengths and then cut to desired lengths in situ. In other embodiments, the longitudinal 214 dimensions of panels 204 may be pre-fabricated to desired lengths.

Panels 204 also comprise one or more panel connector components 226 which are spaced apart from the transverse edges of panels 204 and which are complementary to standoff connector components 228 of standoffs 208 to provide connections 210 therebetween. Panel connector components 226 and their interaction with standoff connector components 228 to provide connections 210 are described in more detail below. With panel connector components 226 coupled to standoff connector components 228 at connections 210, panels 204 are positioned at locations spaced apart from existing structure 10 and from surface 14 thereof to provide space 212 (FIG. 2A).

In the illustrated embodiment of FIGS. 2A and 2B, each panel 204 comprises three panel connector components 226, although this is not necessary. In general, panels 204 of system 200 may be provided with any suitable transverse widths (including a variety of different transverse widths) and may be provided with any suitable number of panel connector components 226 which may depend on the transverse widths of the corresponding panel 204 and on the requirements and/or specifications of a particular application.

System 200 also comprises standoffs 208. Standoffs 208 of the illustrated embodiment comprise generally planar shafts 229 which extend between standoff connector components 228 at one of their transverse edges and optional heads 232 at their opposing transverse edges. Standoffs 208 are also elongated in the longitudinal direction 214. In the illustrated embodiment of FIGS. 2A and 2B, however, the longitudinal 214 dimensions of standoffs 208 are less than the corresponding longitudinal dimensions of panels 204. The FIG. 2B view shows that each panel connector component 226 of the illustrated embodiment connects to, and supports, a pair of standoffs 208 which are longitudinally spaced apart from one another. Providing standoffs 208 with longitudinal dimensions less than the corresponding longitudinal dimensions of panels 204 may reduce the amount of material used to provide standoffs 208 (e.g. in comparison to embodiments where standoffs 208 have longitudinal dimensions that are co-extensive with panels 204). Although not shown in the illustrated embodiment, in some embodiments, standoffs 208 may be provided with one or more apertures between connector components 228 and heads 232 to permit concrete flow therethrough and/or to hold rebar.

Connections 210 between panel connector components 226 and standoff connector components 228 involve the creation of restorative deformation forces which tend to hold standoffs 208 in place relative to panels 204—i.e. to permit standoffs 208 to be "locatable" anywhere along the longitudinal 214 dimensions of panel connector components 226 and panels 204. For example, in cases where the longitudinal direction 214 is at least partially vertically oriented, the restorative deformation forces created in connections 210 may prevent standoffs 208 from moving (e.g. sliding) longitudinally along panel connector components 226 under the force of gravity. In some embodiments, these restorative deformation forces may be sufficient to support rebar against the force of gravity.

As shown best in FIG. 2B, in the illustrated embodiment, standoffs 208 are "located" along panel connector components 226 in a plurality of longitudinally 214 spaced apart rows, wherein standoffs 208 in each row are longitudinally aligned with one another. This arrangement may facilitate the use of rebar in system 200 as explained in more detail below. This arrangement is not necessary, however. In other embodiments, it may be desirable to locate standoffs 208 in a "checkerboard" pattern—e.g. where transversely adjacent standoffs 208 are longitudinally 214 offset from one another but where transversely spaced apart standoffs 208 are longitudinally aligned with one another. In other embodiments, it may be desirable to provide greater longitudinal 214 spacing, less longitudinal 214 spacing or no longitudinal 214 spacing between longitudinally adjacent standoffs 208. In still other embodiments, it may be desirable to provide other arrangements or patterns of standoffs which are "locatable" anywhere on panel connector components 226 of panels 204.

Panel connector components 226, standoff connector components 228 and the formation of connections 210 between panel connector components 226 and standoff connector components 228 are now described in more detail with reference to FIGS. 2C-2F. As can be seen from FIGS. 2C-2F, panel connector component 226 comprises a pair of hooked arms 226A, 226B which initially extend away from interior surface 207 of panel 204 on transversely spaced apart projections 250A, 250B and which curve back toward interior surface 207 to provide corresponding hook concavities 252A, 252B. Hooked arms 226A, 226B of panel connector component 226 also comprise beveled surfaces 254A, 254B which are beveled to extend toward one another as they extend away from interior surface 207 of panel 204. Standoff connector component 228 also comprises a pair of hooked arms 228A, 228B which initially extend away from head 232 (not shown in FIGS. 2C-2F) of standoff 208 and toward interior surface 207 of panel 204 and which curve back toward head 232 (and away from interior surface 207) to provide corresponding hook concavities 256A, 256B. Hooked arms 228A, 228B of standoff connector component 228 also comprise beveled surfaces 258A, 258B which are beveled to extend toward one another as they extend toward head 232 of standoff 208 and away from interior surface 207 of panel 204. Some or all of hooked arms 226A, 226B, 228A, 228B are resiliently deformable such that they can be elastically deformed and exhibit restorative deformation forces which tend to restore the arms to their original shapes and/or positions.

Figure 2C:
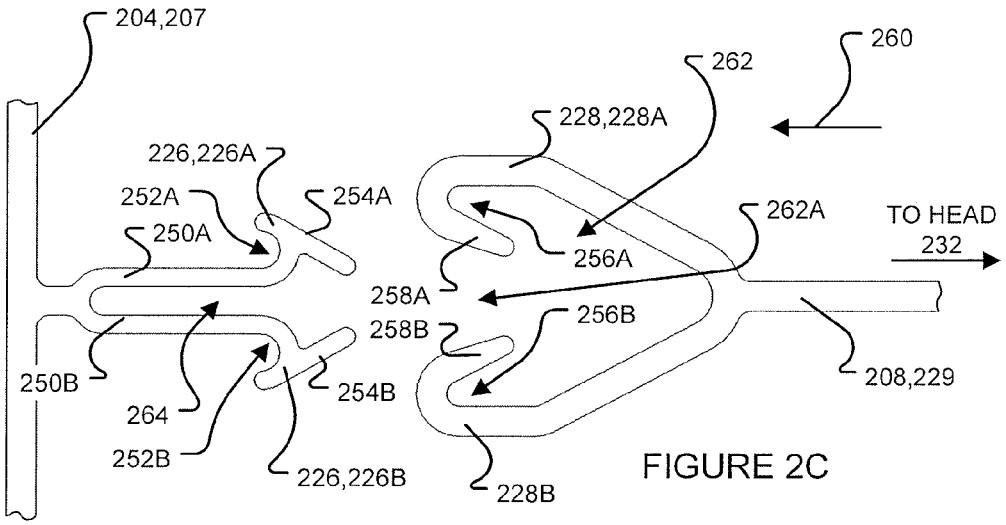
FIGS. 2C-2F show magnified cross-sectional views of the process of coupling a panel connector component of a panel of the FIGS. 2A and 2B system to a standoff connector component of a standoff of the FIGS. 2A and 2B system.
Figure 2D:
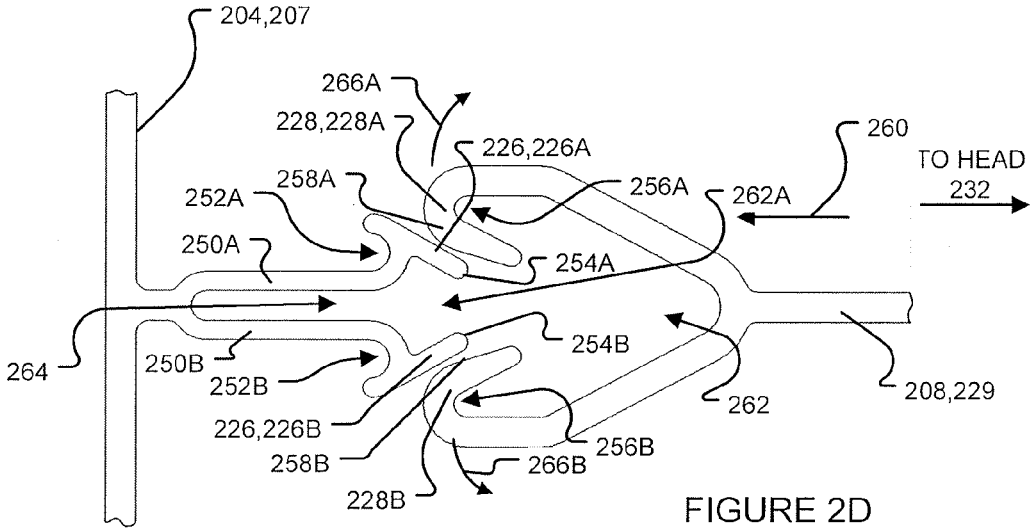
Figure 2E:
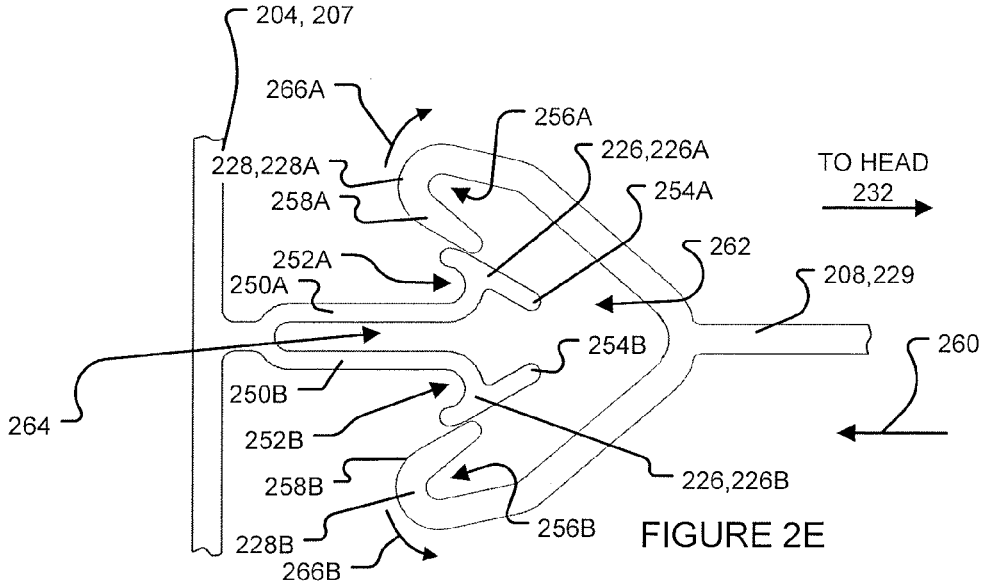
Figure 2F:
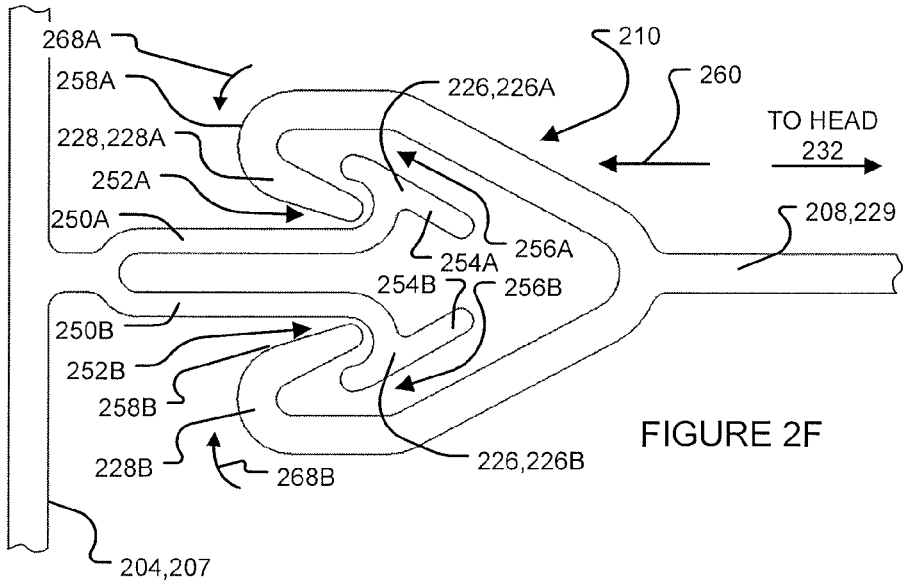

As seen best from FIG. 2F, connection 210 is made when:

- hooked arm 226A of panel connector component 226 engages complementary hooked arm 228A of standoff connector component 228 such that arm 226A of panel connector component 226 extends into and terminates in hook concavity 256A of standoff connector component 228 and arm 228A of standoff connector component 228 extends into and terminates in hook concavity 252A of panel connector component 226; and
- hooked arm 226B of panel connector component 226 engages complementary hooked arm 228B of standoff connector component 228 such that arm 226B of panel connector component 226 extends into and terminates in hook concavity 256B of standoff connector component 228 and arm 228B of standoff connector component 228 extends into and terminates in hook concavity 252B of panel connector component 226.

The process of coupling panel connector component 226 to standoff connector component 228 involves forcing panel 204 and standoff 208 toward one another—e.g. forcing standoff 208 toward panel 204 in direction 260. In the FIG. 2C-2F embodiment, hooked arms 226A, 226B of panel connector components 226 comprise beveled surfaces 254A, 254B and hooked arms 228A, 228B of standoff connector components 228 of standoffs 208 comprise corresponding beveled surfaces 258A, 258B. Beveled surfaces 254A, 254B, 258A, 258B are angled toward one another as they extend away from interior surface 207 of panel 204 and toward head 232 of standoff 208. Coupling panel connector component 226 to standoff connector component 228 involves aligning panel connector component 226 with an opening 262A of space 262 between hooked arms 228A, 228B of standoff connector component 228 (FIG. 2C). As panel connector component 226 and standoff connector component 228 are forced toward one another (e.g. in direction 260), beveled surfaces 254A, 254B abut against beveled surfaces 258A, 258B (FIG. 2D).

Under continued application of force (FIGS. 2D and 2E), beveled surfaces 254A, 254B, 256A, 256B slide against one another as panel connector component 226 passes through opening 262A and into space 262, such that the abutment between beveled surfaces 254A, 254B, 256A, 256B causes:

deformation of hooked arms 228A, 228B, which transversely widens opening 262A; and/or deformation of hooked arms 226A, 226B, which transversely narrows the space 264 between projections 250A, 250B.

More particularly, hooked arm 228A of standoff connector component 228 deforms in a direction 266A away from space 262, hooked arm 228B of standoff connector component 228 deforms in a direction 266B away from space 262, hooked arm 226A of panel connector component 226 deforms toward hooked arm 226B of panel connector component 226, and/or hooked arm 226B of panel connector component 226 deforms toward hooked arm 226A of panel connector component 226. This deformation permits panel connector component 226 to pass through transverse opening 262A and extend into space 262.

As panel connector component 226 and standoff connector component 228 continue to be forced toward one another (e.g. in direction 260), hooked arms 228A, 228B deform in directions 266A, 266B (and/or hooked arms 226A, 226B deform toward one another) until arms 228A, 228B fit past the edges of arms 226A, 226B (i.e. beveled surfaces 258A, 258B move past the edges of beveled surfaces 254A, 254B) and panel connector component 226 is inserted into space 262. At this point, restorative deformation forces (e.g. elastic forces which tend to restore connector components 226, 228 to their original (non-deformed) shapes) cause arms 228A, 228B to move back in directions 268A, 268B such that arms 228A, 228B extend into hook concavities 252A, 252B of panel connector component 226. Directions 268A, 268B may be respectively opposed to directions 266A, 266B. Similarly, restorative deformation forces cause arms 226A, 226B to move transversely away from one another and to extend into hook concavities 256A, 256B of standoff connector components 228. Connection 210 is thereby formed (FIG. 2F).

Hooked arms 226A, 226B, 228A and/or 228B are deformed during formation of connection 210, resulting in the creation of restorative deformation forces. Panel connector component 226 and standoff connector component 228 are shaped such that the restorative deformation forces associated with the deformation of hooked arms 226A, 226B, 228A and/or 228B are maintained after the formation of connection 210—i.e. after the formation of connection 210, hooked arms 226A, 226B, 228A and/or 228B are not restored all the way to their original non-deformed shapes, resulting in the existence of restorative deformation forces after the formation of connection 210. As discussed above, these restorative deformation forces allow standoffs 208 to be "located" anywhere along the longitudinal 214 dimension of panels 204. In other words, connection 210 is a form of press fit, where the friction caused by restorative deformation forces maintains the location of the standoffs 208 relative to panels 204. In particular embodiments, these restorative deformation forces are sufficient to permit standoffs 208 to be located without substantial movement under the force of gravity acting on standoffs 208. In some embodiments, these restorative deformation forces are sufficient to permit standoffs 208 to also support rebar without substantial movement under the force of gravity acting on standoffs 208 and the supported rebar.

The "locatability" of standoffs 208 at various locations along panels 204 can add versatility to the process of fabricating system 200. For example, in some applications, standoffs 208 may be connected to panels 204 using connections 210 at desired locations prior to connecting panels 204 to one another in edge-adjacent relationship at connections 206. In other applications, standoffs 208 may be connected to panels 204 using connections 210 at desired locations after connecting panels 204 to one another in edge-adjacent relationship at connections 206. The order of assembly of connections 210 and connections 206 may depend on the particular circumstances of a given application. It will be appreciated though that added versatility is advantageous, because spatial constraints of particular applications may make it difficult to assemble system 200 in one order versus the other. Another advantage of the locatability of standoffs 208 at various locations along panels 204 is that standoffs 208 need not be connected to existing structure 10 prior to or after making connections 210.

Since panel connector component 226 is forced into and extends into space 262 between arms 228A, 228B of standoff connector component 228, panel connector component 226 may be considered to be a "male" connector component corresponding to the "female" standoff connector component 228. In other embodiments, standoff connector components 228 may comprise male connector components and panel connector components 226 may comprise female connector components.

The illustrated embodiment of FIGS. 2A and 2B shows standoffs 208 which have longitudinal 214 dimensions less than those of panels 204, but this is not necessary. In some embodiments, the longitudinal dimensions of standoffs may be co-extensive with the longitudinal dimensions of panels.

Standoffs 208 may comprise optional heads 232 which may be located opposite standoff connector components 228 on shafts 229. Optional heads 232 may abut against existing structure 10. Optional heads 232 may extend longitudinally 214 and transversely 216 at the inner edges of standoffs 208. That is, optional heads 232 may have a surface area facing away from standoff connector components 228 that is greater than the surface area of shafts 229 facing away from standoff connector components 228. Optional heads 232 may thereby serve to anchor standoffs 208 (and thereby panels 204) in the curable material once it cures and to disperse some of the forces which may occur if and when standoffs 208 abut against existing structure 10. In the illustrated embodiment of FIGS. 2A and 2B, heads 232 have a generally H-shaped cross-section. In other embodiments, the heads of standoffs may be provided with other suitable shapes. In the FIG. 2A illustration, standoffs 208 are shown sized so that there is no abutting interaction or contact between heads 232 and existing structure 10. However, during fabrication of system 200, system 200 may not be perfectly centered relative to existing structure 10 which may cause interaction of some of heads 232 with existing structure 10. Also, in other embodiments, the tolerances may be made tighter, so that there will be abutting interaction between existing structure 10 and at least some of heads 232 of some of standoff 208. Heads 232 are not necessary. In some embodiments, generally planar shafts 229 of standoffs 208 may extend to the transverse edge of standoffs 208 opposite that of standoff connector components 228.

As shown best in FIG. 2B, generally planar shafts 229 of standoffs 208 may comprise optional rebar-chair concavities 234. Rebar-chair concavities 234 may comprise upwardly (e.g. longitudinally 214 in the illustrated embodiment) opening concavities 234 which may serve to support and locate transversely 216 extending rebar (not shown). Vertically (e.g. longitudinally 214) extending rebar may be coupled to the transversely 216 extending rebar using, for example, rebar ties as is known in the art. It will be appreciated that the use of rebar is optional and may be used in applications where extra strength and/or robustness is desirable from repair structure 202. Advantageously, the restorative deformation forces created by the connections 210 between panel connector components 226 and standoff connector components 228 may be sufficiently strong to support the weight of both standoffs 208 and any supported rebar. In some embodiments, rebar-chair concavities 234 may be fabricated by "punching" or cutting out the concavities from generally planar shafts 229 of extruded standoffs 208. In other embodiments, standoffs 208 may be injection molded or fabricated from some other suitable process, such that rebar-chair concavities are directly formed in shafts 229 during the fabrication of standoffs 208.

In the illustrated embodiment, standoffs 208 are solid (i.e. non-apertured). In other embodiments, generally planar shafts 229 of standoffs 208 may be apertured. Such apertures may extend in the longitudinal direction 214 and in a direction between standoff connector components 228 and standoff heads 232 so as to permit the flow of curable material through standoffs 208. In some embodiments, such apertures may also serve to support and locate transversely extending rebar in a manner similar to rebar-chair concavities 234.

In the illustrated embodiment of FIGS. 2A and 2B, each panel 204 (and each corner panel 204A) comprises a generally male connector component 220A at one of its transverse ends and a generally female connector component 220B at the other one of its transverse ends. In the illustrated embodiment, male connector components 220A and female connector components 220B are complementary to one another, such that male connector component 220A of one panel may be connected to female connector components 220B of a corresponding edge-adjacent panel 204 to form edge-adjacent panel connections 206. More particularly, in the illustrated embodiment, edge-adjacent panel connections 206 may be formed by pushing a protrusion (not explicitly enumerated) of male connector component 220A into a complementary concavity (not explicitly enumerated) of female connector component 220B, such that one or more features (e.g. concavities and/or convexities) on the exterior of the protrusion of male connector component 220A engage one or more complementary features (e.g. concavities and/or convexities) on the interior of the concavity of female connector component 220B.

The form of connector components 220A, 220B that form edge-adjacent panel connections 206 in the illustrated embodiment represents one particular and non-limiting type of connection between edge-adjacent panels. In other embodiments, other forms of connections (and other forms of corresponding connector components) may be provided between edge-adjacent panels. Non-limiting examples of suitable edge-adjacent panel connections and corresponding connector components are described in PCT patent publication Nos. WO2008/119178, WO2010/078645, WO2009/059410, and WO2010/094111 which are hereby incorporated herein by reference. In some of these exemplary connections between edge-adjacent panels, two edge-adjacent panels are connected directly to one another without the use of third connector components. This is the case, for example, in the connections 206 between edge-adjacent panels 204 of the illustrated embodiment of FIGS. 2A and 2B. In some of the other exemplary connections between edge-adjacent panels, two edge-adjacent panels are connected to one another using a third connector component, such as a clip, an edge-connecting standoff, an edge-connecting anchor component and/or the like. Embodiments of the invention that is the subject of this disclosure may accommodate either of these forms of connection between edge-adjacent panels (i.e. with or without third connector components).

System 200 of the FIGS. 2A and 2B embodiment comprises outside corner panels 204A, which may be used to conform the shape of system 200 to the general shape of existing structure 10—e.g. a rectangular cross-section in the case of the illustrated embodiment. Corner panels 204A may comprise optional corner braces 230 which reinforce their corresponding corners, although corner braces 230 are not necessary. In the illustrated embodiment of FIGS. 2A and 2B, corner panels 204A include connector components 220A, 220B at their respective transverse edges for connecting to edge-adjacent panels 204, but corner panels 204A do not include panel connector components 226 for connecting to standoffs 208. In some embodiments, however, corner panels may be provided with panel connector components similar to panel connector components 226 for connecting to standoffs 208. Corner panels 204A of the illustrated embodiment subtend 90° outside corners. In other embodiments (for example, where the existing structure has a different shape), corner panels 204A may be provided with outside corners subtending other angles or inside corners subtending any suitable angles. Depending on the shape of the existing structure, corner panels may not be necessary in some embodiments.

Figure 3:
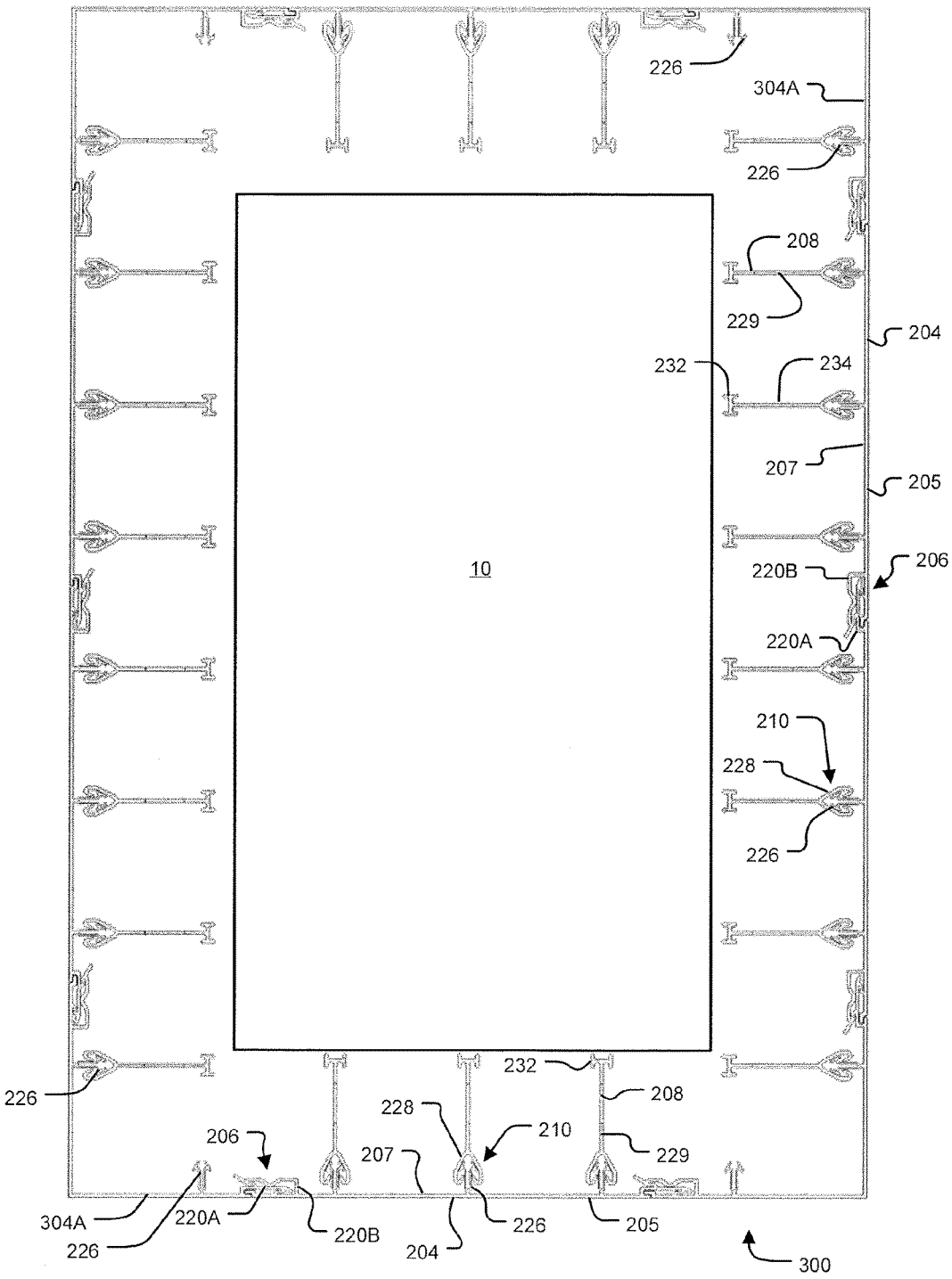
FIG. 3 is a cross-sectional plan view of a system for building a repair structure and thereby repairing the FIG. 1A existing structure according to another example embodiment.

FIG. 3 is a cross-sectional plan view of a system 300 for building a repair structure 302 and thereby repairing existing structure 10 (FIG. 1A) according to another example embodiment. In many respects, system 300 is similar to system 200 and similar reference numerals are used to refer to similar features. More particularly, system 300 includes panels 204 and standoffs 208 which are substantially similar to panels 204 and standoffs 208 described above. System 300 differs from system 200 principally in that system 300 incorporates corner panels 304A which are different from corner panels 204A of system 200. Corner panels 304A of system 300 include panel connector components 226 which may be connected to standoffs 208 as described above. In the illustrated embodiment, corner panels 304A comprise a pair of panel connector components 226 (one panel connector component 226 on each transverse leg of each corner panel 304A).

In the illustrated embodiment, only one of the standoff connector components 226 on each corner panel 304A is in use to connect to a standoff 208, but this is not necessary. In some embodiments, each standoff connector component 226 on corner panels 304A may be connected to standoffs 208 which may be "located" at different longitudinal positions or which may have less extension toward existing structure 10 so that they do not interfere with one another. Corner panels 304A of the FIG. 3 embodiment are also shown without optional corner braces. In some embodiments, corner panels 304A may be provided with corner braces similar to corner braces 230 described above for corner panels 204A. In other respects, system 300 may be similar to system 200 described herein.

Figure 4A:
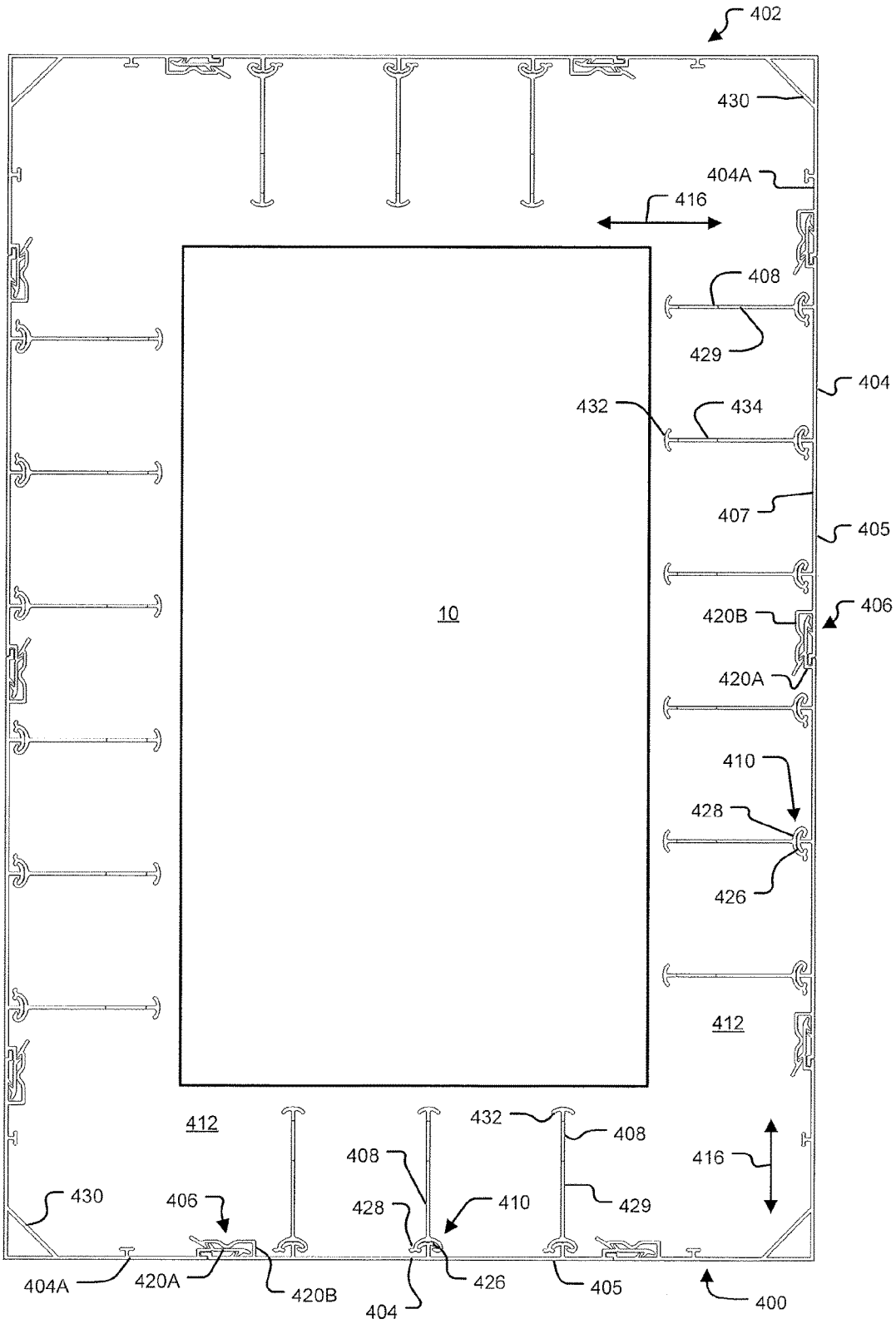
FIGS. 4A and 4B are respectively cross-sectional plan and cross-sectional isometric views of a system for building a repair structure and thereby repairing the FIG. 1A existing structure according to another example embodiment.
Figure 4B:
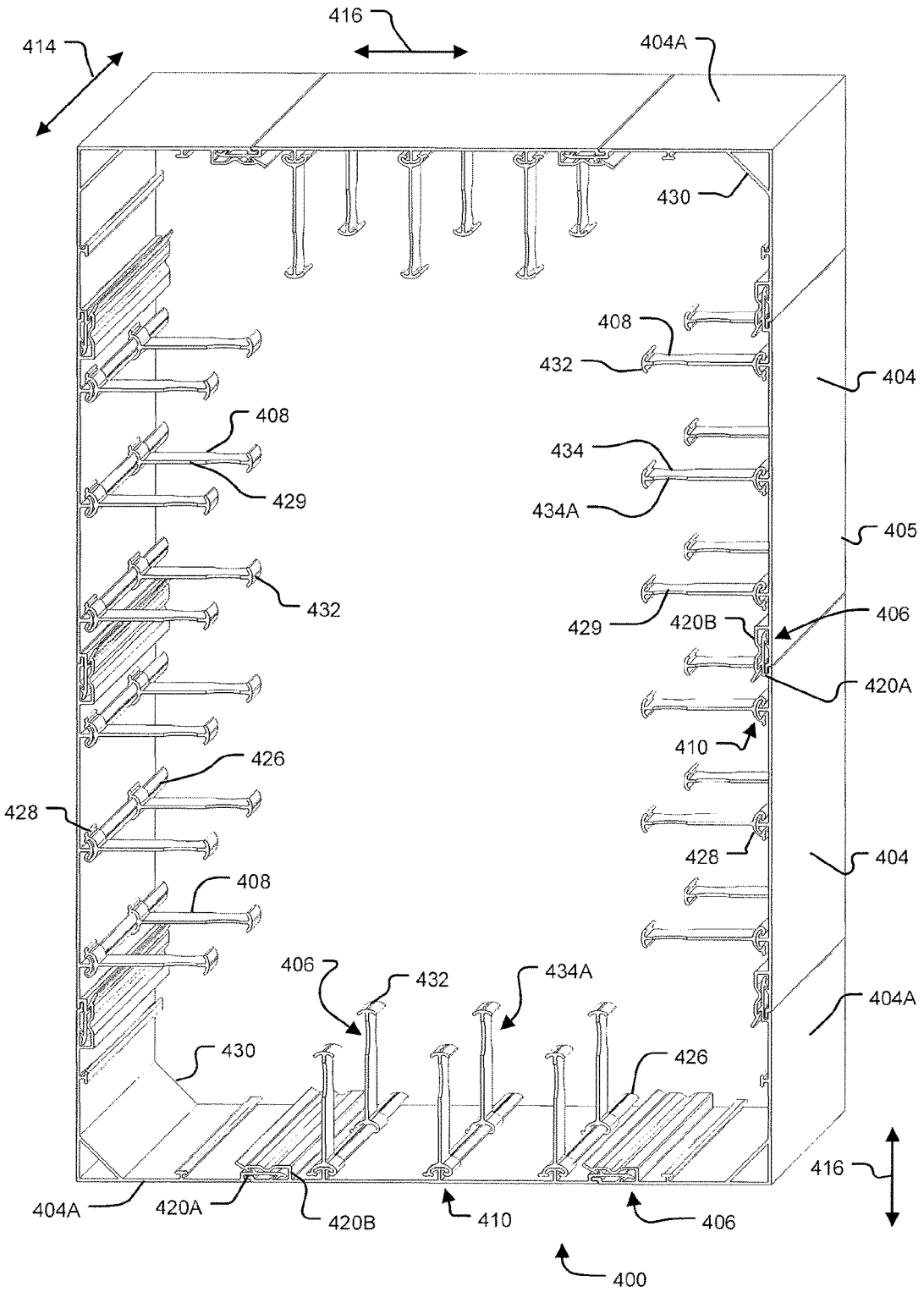

FIGS. 4A and 4B are respectively cross-sectional plan and cross-sectional isometric views of a system 400 for building a repair structure 402 and thereby repairing existing structure 10 (FIG. 1A) according to another example embodiment. For simplicity, existing structure 10 is not shown in FIG. 4B and damaged regions 16 of existing structure 10 are not shown in FIG. 4A. System 400 is similar in many respects to system 200 described above and similar reference numbers are used to refer to similar components, except that the reference numbers of system 400 are preceded by the numeral "4", whereas the reference number of system 200 are preceded by the numeral "2". System 400 comprises: a plurality of panels 404 connected to one another in edge-adjacent relationship by connections 406; and a plurality of standoffs 408 connected to panels 404 (at connections 410) and extending away from interior surfaces 407 of panels 404 toward existing structure 10. Panels 404 extend in a longitudinal direction 414 (into and out of the page in FIG. 4A) and in transverse directions 416 (in the plane of the page in FIG. 4A) to provide exterior surfaces 405 and interior surfaces 407. In the illustrated embodiment, system 400 also comprises a plurality of outside corner panels 404A which are substantially similar to outside corner panels 204A described above. In other embodiments, outside corner panels similar to outside corner panels 304A (FIG. 3) could be used in the place of outside corner panels 404A. Repair structure 402 is formed when concrete (or some other curable material) is introduced into space 412 between panels 404 and existing structure 10. Extension of standoffs 408 into space 412 anchors panels 404 to the curable material as it cures, thereby providing repair structure 402 with a cladding.

Panels 404 of system 400 are similar to panels 204 of system 200 in that panels 404 are generally planar and comprise connector components 420A, 420B at their respective transverse ends which connect to one another to provide edge-adjacent panel connections 406 which connect panels 404 in edge-adjacent relationship in a manner substantially identical to connector components 220A, 220B and edge-adjacent panel connections 206 described above. Connections 406 between edge-adjacent panels 404 may additionally or alternatively implemented according to any of the variations described above.

Panels 404 of system 400 differ from panels 204 of system 200 in that panels 404 comprise panel connector components 426 which are shaped differently and function differently than panel connector components 226. Like panel connector components 226, panel connector components 426 are complementary to standoff connector components 428 of standoffs 408 to provide connections 410 therebetween. Panel connector components 426 interact with standoff connector components 428 to provide connections 410, described in more detail below. Like panels 204 of system 200, panels 404 of system 400 comprise three panel connector components 426, although this is not necessary. In general, panels 404 of system 400 may be provided with any suitable transverse widths (including a variety of different transverse widths) and may be provided with any suitable number of panel connector components 426 which may depend on the transverse widths of the corresponding panel 404 and on the requirements and/or specifications of a particular application.

System 400 also comprises standoffs 408 that are similar in many respects to standoffs 208 described above in that standoffs 408 connect to panels 404 at connections 410 and extend in longitudinal direction 414 and away from interior surfaces 407 of panels 404 toward existing structure 10. As is the case with standoffs 208 described above, the longitudinal 414 dimensions of standoffs 408 are less than the corresponding longitudinal dimensions of panels 404. The FIG. 4B view shows that each panel connector component 426 of the illustrated embodiment connects to, and supports, a pair of standoffs 408 which are longitudinally spaced apart from one another. Providing standoffs 408 with longitudinal dimensions less than the corresponding longitudinal dimensions of panels 404 may reduce the amount of material used to provide standoffs 408 (e.g. in comparison to embodiments where standoffs have longitudinal dimensions that are coextensive with panels). This is not necessary, however; in some embodiments, the longitudinal dimensions of standoffs may be coextensive with the longitudinal dimensions of panels.

Standoffs 408 are also similar to standoffs 208 in that generally planar shafts 429 of standoffs 408 comprise optional rebar-chair concavities 434 which may be substantially similar to optional rebar-chair concavities 234 of standoffs 208. In the illustrated embodiment, standoffs 408 are solid (i.e. non-apertured). In other embodiments, generally planar shafts 429 of standoffs 408 may be apertured in a manner similar to that discussed above for standoffs 208.

Standoffs 408 of the FIGS. 4A and 4B embodiment comprise optional heads 432 which are different from optional heads 232 of standoffs 208. Optional heads 432 extend longitudinally 414 and transversely 416 and may function to anchor standoffs 408 (and thereby panels 404) in the curable material once it cures and to disperse some of the forces which may occur if and when standoffs 408 abut against existing structure 10 in a manner similar to optional heads 232 of standoffs 208. However, optional heads 432 differ from optional heads 232 in that optional heads 432 have a shape that is substantially similar to the shape of panel connector components 426. This shape of optional heads 432 permits stacking multiple standoffs 408 to one another, as described in more detail below.

Standoffs 408 also comprise standoff connector components 428 which are shaped differently, and which function differently, from standoff connector components 228 of standoffs 208. Like standoff connector components 228, standoff connector components 428 are complementary to panel connector components 426 of panels 404 to provide connections 410 therebetween. Connections 410 share a number of similarities to connections 210 described above. More particularly, connections 410 between panel connector components 426 and standoff connector components 428 involve the creation of restorative deformation forces which tend to hold standoffs 408 in place relative to panels 404—i.e. to permit standoffs 408 to be "locatable" anywhere along the longitudinal 414 dimensions of panel connector components 426 and panels 404. For example, in cases where the longitudinal direction 414 is at least partially vertically oriented, the restorative deformation forces created in connections 410 may prevent standoffs 408 from moving (e.g. sliding) longitudinally along panel connector components 426 under the force of gravity. In some embodiments, these restorative deformation forces created when forming connections 410 may be sufficient to support the weight of both standoffs 408 and rebar supported thereon.

As shown best in FIG. 4B, in the illustrated embodiment, standoffs 408 are "located" along panel connector components 426 in a plurality of longitudinally 414 spaced apart rows, wherein standoffs 408 in each row are longitudinally aligned with one another. This arrangement is not necessary, however. In other embodiments, it may be desirable to locate standoffs 408 in other arrangements or patterns similar to those described above for standoffs 208.

Panel connector components 426, standoff connector components 428 and the formation of connections 410 between panel connector components 426 and standoff connector components 428 are now described in more detail with reference to FIGS. 4C-4F. As can be seen from FIGS. 4C-4F, panel connector component 426 comprises: a planar central shaft 427 which extends inwardly away from interior surface 407 of panel 404; and a pair of hooked arms 426A, 426B which extend transversely from a location on shaft 427 spaced apart from interior surface 407 of panel 404 and curve back toward interior surface 407 to provide corresponding hook concavities 452A, 452B. Hooked arms 426A, 426B may be symmetrical with respect to central shaft 427. Standoff connector component 428 also comprises a pair of hooked arms 428A, 428B which initially extend transversely away from generally planar shaft 429 of standoff 408 and which curve back toward shaft 429 of standoff 408 to provide corresponding hook concavities 456A, 456B. Standoff connector component 428 also comprises a protrusion 433 which extends from shaft 429 and away from head 432 of standoff 408 at a location between hooked arms 428A, 428B.

Figure 4C:
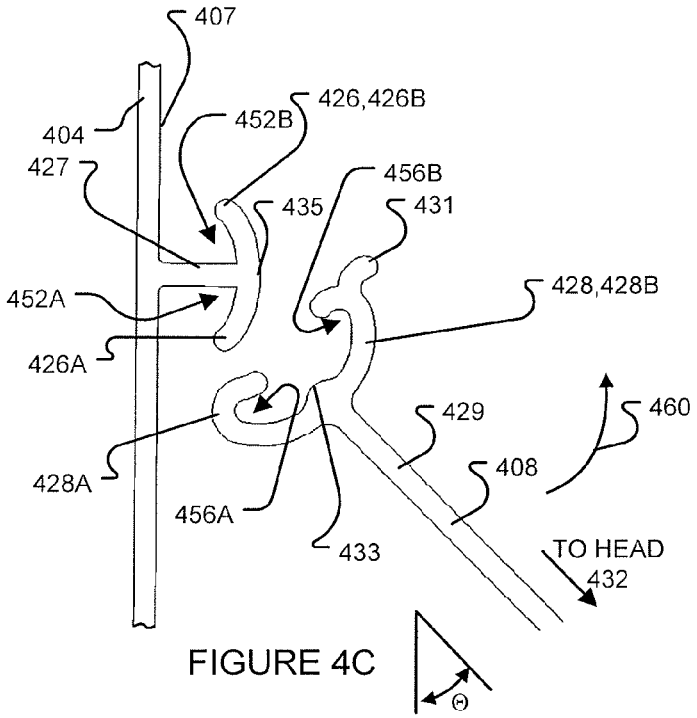
FIGS. 4C-4F show magnified cross-sectional views of the process of coupling a panel connector component of a panel of the FIGS. 4A and 4B system to a standoff connector component of a standoff of the FIGS. 4A and 4B system.

As can be seen best from FIG. 4C, hooked arms 428A, 428B and corresponding hook concavities 456A, 456B of the illustrated embodiment are not symmetrical with respect to generally planar shaft 429. More particularly, primary hooked arm 428A of the illustrated embodiment is more sharply curved (i.e. has a smaller radius of curvature) than secondary hooked arm 428B. Also, primary hooked arm 428A of the illustrated embodiment actually curves around so much that it begins to extend back toward head 432 of standoff 408, whereas secondary hooked arm 428B only curves back toward shaft 429, but not toward head 432. Further, primary hook concavity 456A comprises a deeper concavity than secondary hook concavity 456B. As a result, a greater moment is required to disengage primary hooked arm 428A than to disengage secondary hooked arm 428B. In addition, this configuration tends to facilitate connecting standoff connector component 428 to panel connector component 426 by first engaging primary hooked arm 428A then engaging secondary hooked arm 428B as described below. Secondary hooked arm 428B also comprises a thumb 431 which extends away from corresponding secondary hook concavity 456B and away from shaft 429 on a side of secondary hooked arm 428B opposite secondary hook concavity 456B.

Figure 4D:
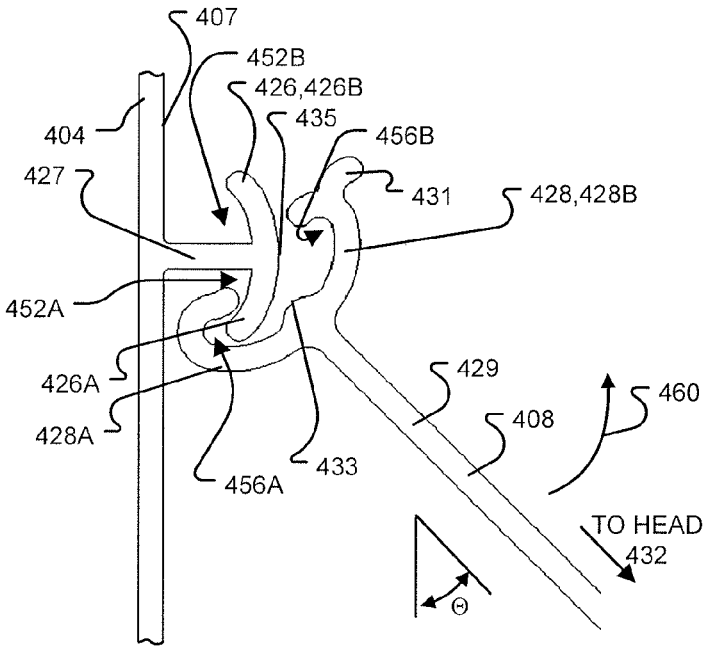
Figure 4E:
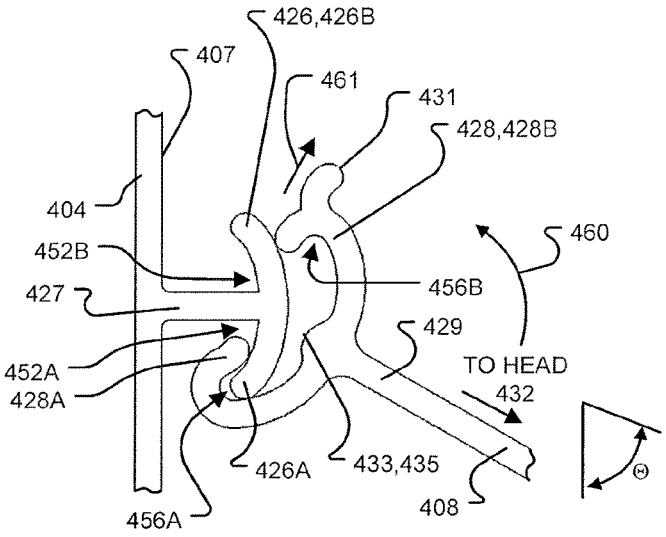
Figure 4F:
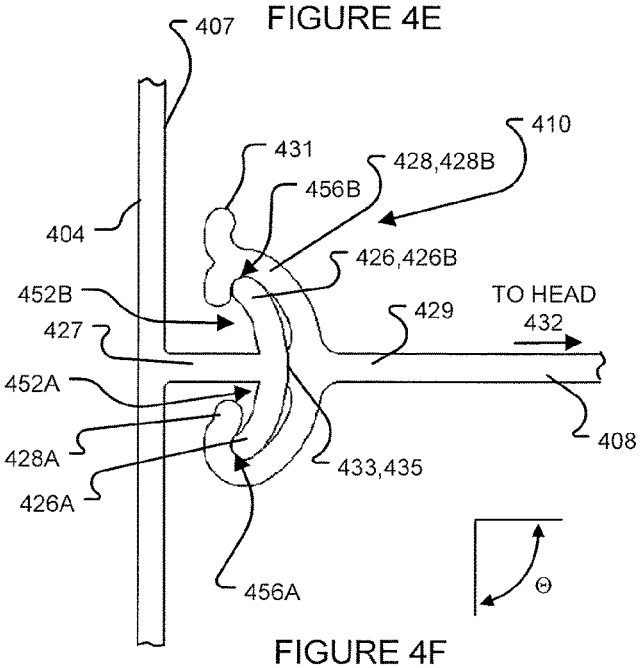

As seen best from FIG. 4F, connection 410 is made when:

hooked arm 426A of panel connector component 426 engages complementary primary hooked arm 428A of standoff connector component 428 such that arm 426A of panel connector component 426 extends into and terminates in primary hook concavity 456A of standoff connector component 428 and primary hooked arm 428A of standoff connector component 428 extends into and terminates in hook concavity 452A of panel connector component 426;

hooked arm 426B of panel connector component 426 engages complementary secondary hooked arm 428B of standoff connector component 428 such that arm 426B of panel connector component 426 extends into and terminates in secondary hook concavity 456B of standoff connector component 428 and secondary hooked arm 428B of standoff connector component 428 extends into and terminates in hook concavity 452B of panel connector component 426; and protrusion 433 abuts against an apex 435 of panel connector component 426.

The process of coupling panel connector component 426 to standoff connector component 428 involves forcing relative pivotal motion between panel 404 and standoff 408—e.g. forcing standoff 408 to pivot relative to panel 404 in direction 460. Coupling panel connector component 426 to standoff connector component 428 involves initially aligning standoff 408 relative to panel 404 at a suitable initial angle θ (FIG. 4C) between the transverse extension of panel 404 and the extension of generally planar shaft 429 of standoff 408. In some embodiments, the initial angle θ may be in a range of 0°-80°. In some embodiments, the initial angle θ may be in a range of 30°-80°. Next, primary hooked arm 428A of standoff connector component 428 is engaged with corresponding hooked arm 426A of panel connector component 426 such that primary hooked arm 428A extends into hook concavity 452A and hooked arm 426A extends into primary hook concavity 456A (FIG. 4D).

Relative pivotal motion is then effected (e.g. in direction 460) between panel 404 and standoff 408 while primary hooked arm 428A remains extended into hook concavity 452A and hooked arm 426A remains extended into primary hook concavity 456A (FIG. 4D) until secondary hooked arm 428B of standoff connector component 428 contacts hooked arm 426B of panel connector component 426 on a side opposite hook concavity 452B (FIG. 4E). At this stage, in some embodiments, the angle θ may be in a range of 45°-88°. At this stage, in some embodiments, the angle θ may be in a range of 60°-85°. The continued application of the torque which causes relative pivotal motion between panel 404 and standoff 408 (e.g. in direction 460) causes corresponding deformation of hooked arms 428A, 428B which tends to spread hooked arms 428A, 428B transversely away from one another. For example, secondary hooked arm 428B may be deformed in direction 461 and/or primary hooked arm 428A may be deformed in a direction opposite direction 461 (FIG. 4E). This deformation allows secondary hooked arm 428B of standoff connector component 408 to pass by the transversely outermost extent of hooked arm 426B.

When secondary hooked arm 428B of standoff connector component 408 moves past the transversely outermost extent of hooked arm 426B, restorative deformation forces (e.g. elastic forces which tend to restore hooked arms 428A, 428B to their original (non-deformed) states) cause secondary hooked arm 428B to move back toward primary hooked arm 428A, such that secondary hooked arm 428B of standoff connector component 428 moves into hook concavity 452B of panel connector component 426 and hooked arm 426B of panel connector component 426 moves into secondary hook concavity 456B of standoff connector component 428. Connection 410 is thereby formed (FIG. 4F) with the angle θ approximately 90°±5°.

Hooked arms 428A and/or 428B are deformed during formation of connection 410, resulting in the creation of restorative deformation forces. Panel connector component 426 and standoff connector component 428 are shaped such that the restorative deformation forces associated with the deformation of hooked arms 428A and/or 428B are maintained after the formation of connection 410—i.e. after the formation of connection 410, hooked arms 428A and/or 428B are not restored to their original non-deformed state, resulting in the existence of restorative deformation forces after the formation of connection 410. As discussed above, these restorative deformation forces allow standoffs 408 to be "located" anywhere along the longitudinal 414 dimension of panels 404. In particular embodiments, these restorative deformation forces are sufficient to permit standoffs 408 to be located without substantial movement under the force of gravity acting on standoffs 408. In some embodiments, these restorative deformation forces are sufficient to permit standoffs 408 to also support rebar without substantial movement under the force of gravity acting on standoffs 408 and the supported rebar.

The "locatability" of standoffs 408 at various locations along panels 404 can add versatility to the process of fabricating system 400. For example, in some applications, standoffs 408 may be connected to panels 404 using connections 410 at desired locations prior to connecting panels 404 to one another in edge-adjacent relationship at connections 406. In other applications, standoffs 408 may be connected to panels 404 using connections 410 at desired locations after connecting panels 404 to one another in edge-adjacent relationship at connections 406. The order of assembly of connections 410 and connections 406 may depend on the particular circumstances of a given application. It will be appreciated though that added versatility is advantageous, because spatial constraints of particular applications may make it difficult to assemble system 400 in one order versus the other. Another advantage of the locatability of standoffs 408 at various locations along panels 404 is that standoffs 408 need not be connected to existing structure 10 prior to or after making connections 410.

Connections 410 between standoff connector components 428 and panel connector components 426 have the additional advantage that if it is desired to disconnect a connection 410, force may be exerted on thumb 431 to exert torque that would tend to cause relative pivotal motion between standoff 408 and panel 404 (e.g. in a direction opposite direction 460). Such torque can deform one or both of connector components 426, 428 to thereby disconnect connection 410 and allow standoff 408 to be re-"located" at another desired location.

It will be appreciated that panel connector component 426 is symmetrical about its planar shaft 427. Consequently, standoff 408 may be reversed, so that standoff connector component 428 can be connected to panel connector component 426 by relative pivotal movement in the opposite direction to that shown in FIGS. 4C-4F. Where standoff 408 is reversed in this manner, connection 410 is made when:

hooked arm 426B of panel connector component 426 engages complementary primary hooked arm 428A of standoff connector component 428 such that arm 426B of panel connector component 426 extends into and terminates in primary hook concavity 456A of standoff connector component 428 and primary hooked arm 428A of standoff connector component 428 extends into and terminates in hook concavity 452B of panel connector component 426;

hooked arm 426A of panel connector component 426 engages complementary secondary hooked arm 428B of standoff connector component 428 such that arm 426A of panel connector component 426 extends into and terminates in secondary hook concavity 456B of standoff connector component 428 and secondary hooked arm 428B of standoff connector component 428 extends into and terminates in hook concavity 452A of panel connector component 426; and protrusion 433 abuts against an apex 435 of panel connector component 426.

It will be appreciated that the ability to reverse standoffs 408 and to connect standoff connector components 428 to panel connector components 426 using relative pivotal movement in either direction increases the flexibility of assembly of system 400 and can be particularly useful in circumstances where physical constraints impede forming the connection from one side. To facilitate the reversal of standoffs 408, standoffs 408 may comprise additional optional rebar-chair concavities 434A at their opposing longitudinal ends (see FIG. 4B).

Since panel connector component 426 is forced and extends into the space between arms 428A, 428B of standoff connector component 428, panel connector component 426 may be considered to be a "male" connector component corresponding to the "female" standoff connector component 428. In other embodiments, standoff connector components 428 may comprise male connector components and panel connector components 426 may comprise female connector components.

In other respects, system 400 may be similar to system 200, panels 404 may be similar to panels 204 and standoffs 408 may be similar to standoffs 208 described herein.

Figure 1B:
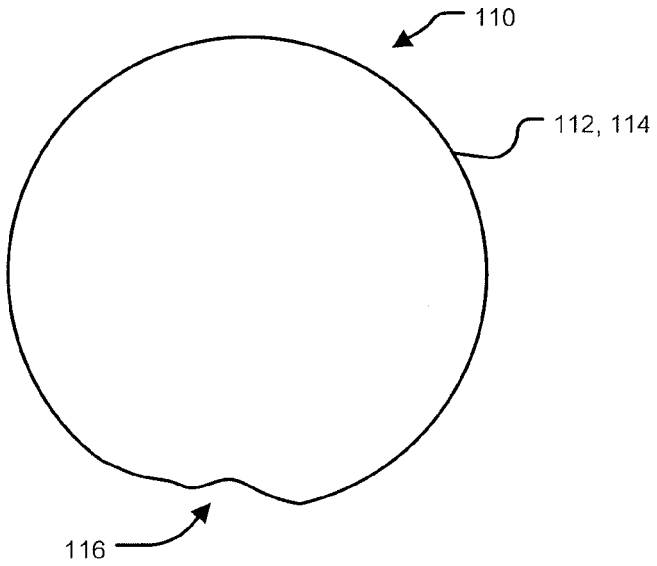
Figure 5:
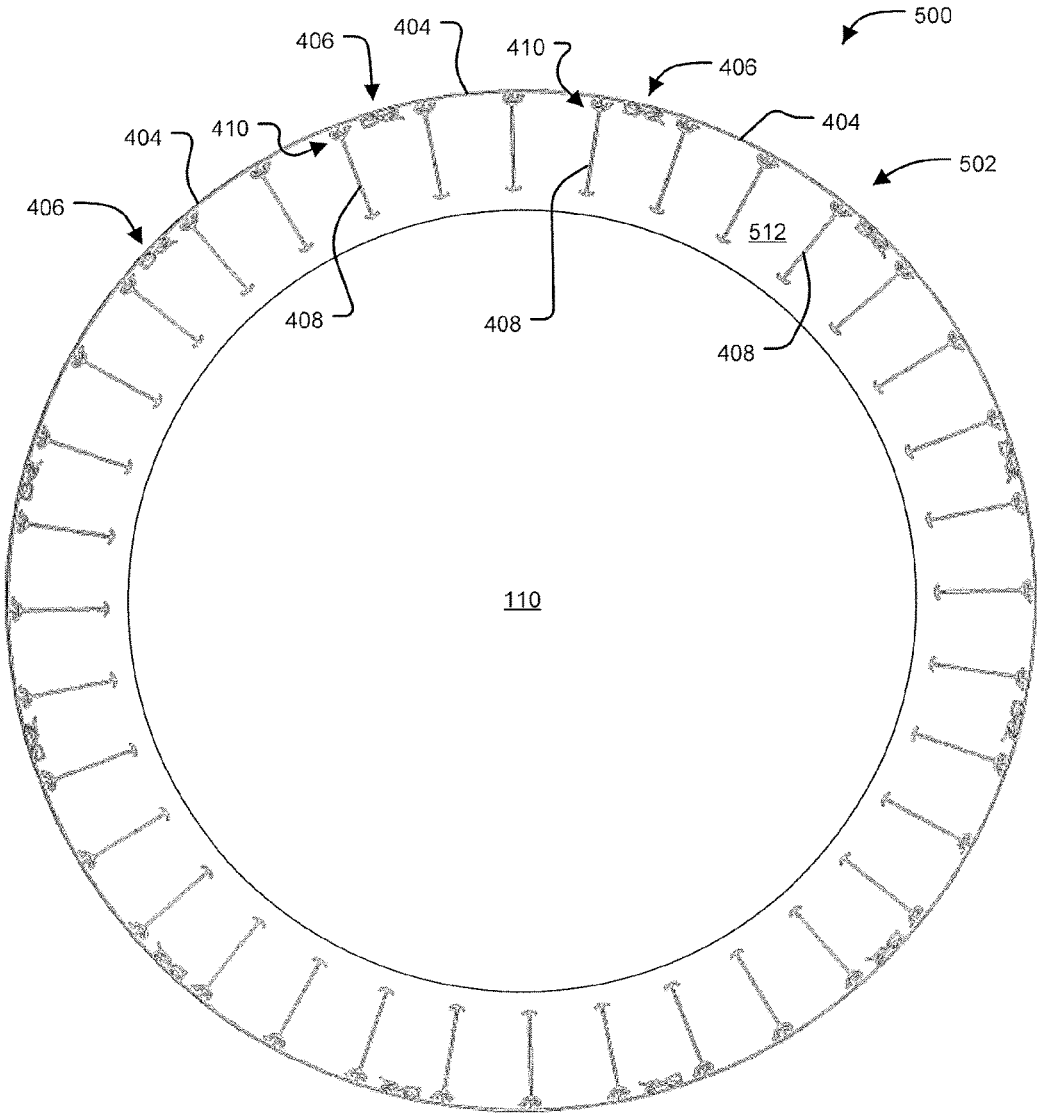
FIG. 5 is a cross-sectional plan view of a system for building a repair structure and thereby repairing the FIG. 1B existing structure according to an example embodiment.

FIG. 5 is a cross-sectional plan view of a system 500 for building a repair structure 502 and thereby repairing existing structure 110 (FIG. 1B) according to another example embodiment. For simplicity, damaged regions 116 of existing structure 110 are not shown in FIG. 5. In many respects, system 500 is similar to system 400 and similar reference numerals are used to refer to similar features. More particularly, system 500 includes panels 404 and standoffs 408 which are substantially similar to panels 404 and standoffs 408 described above. Panels 404 of system 500 are connected to one another in edge-adjacent relationships at edge-adjacent panel connections 406 which are substantially similar to edge-adjacent panel connections 406 of system 400 described above. Standoffs 408 of system 500 are connected to panels 404 at connections 410 which are substantially similar to connections 410 of system 400 described above.

System 500 differs from system 400 principally in that system 500 is used to build a generally annular repair structure 502 around a generally cylindrical existing structure 110. Accordingly, system 500 does not use corner panels 404A. In the currently preferred embodiment, panels 404 of system 500 are the same as panels 404 of system 400, but are deformed when edge-adjacent connections 406 are made to provide the arcuate transverse shape of panels 404 in system 500. In some embodiments, panels may be fabricated to have an arcuate transverse shape and need not be deformed in this manner to provide the shape shown in FIG. 5.

Concrete (or other curable material) is added to the space 512 between panels 404 and existing structure 110 to complete the fabrication of repair structure 502. While not shown in the illustrated embodiments, repair structure 502 may comprise rebar which may be placed in space 512 (e.g. in rebar-chair concavities of standoffs 408) prior to the introduction of curable material. Extension of standoffs 408 into space 512 anchors panels 404 to the curable material as it cures, thereby providing repair structure 502 with a cladding. In some embodiments, panels 404 may provide the formwork needed to contain the curable material in space 512 until it cures. In other embodiments, panels 404 may be braced by external bracing (not shown) which may assist panels 404 to contain the curable material in space 512. In still other embodiments, panels 404 may provide a cladding which lines the interior of an external formwork (not shown) and the external formwork may provide the strength to contain the curable material in space 512 until it cures.

In other respects, system 500 is similar to system 400.

Figure 6:
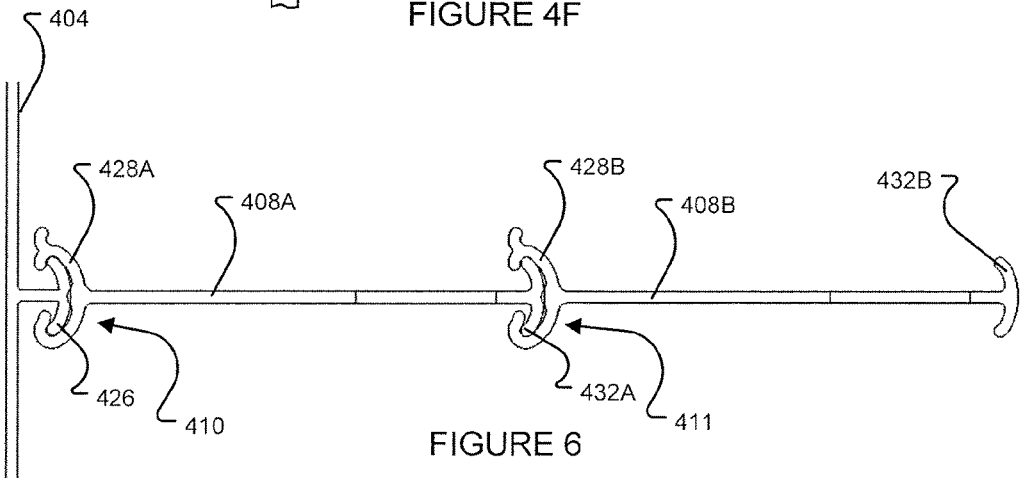
FIG. 6 is a cross-sectional plan view of a pair of stacked standoffs according to a particular embodiment.

FIG. 6 is a cross-sectional plan view of a pair of stacked standoffs 408A, 408B (together standoffs 408) which depict an additional feature of standoffs 408. As previously discussed, standoffs 408 comprise a head 432 which has a shape similar to panel connector components 426 of panels 404. This permits a plurality of standoffs 408 to be stacked to one another as shown in FIG. 6. In the particular case of the FIG. 6 example, a first connection 410 is made between panel connector component 426 and standoff connector component 428A of standoff 408A and a second connection 411 is made between head 432A of standoff 408A and standoff connector component 428B of standoff 408B. If desired, an additional standoff 408 could be connected to head 432B of standoff 408B. It will be appreciated that the ability to stack pluralities of standoffs 408 together provides additional versatility for fabricating repair structures—e.g. where it is desired to provide a repair structure having different depths at different locations.

Figure 7A:
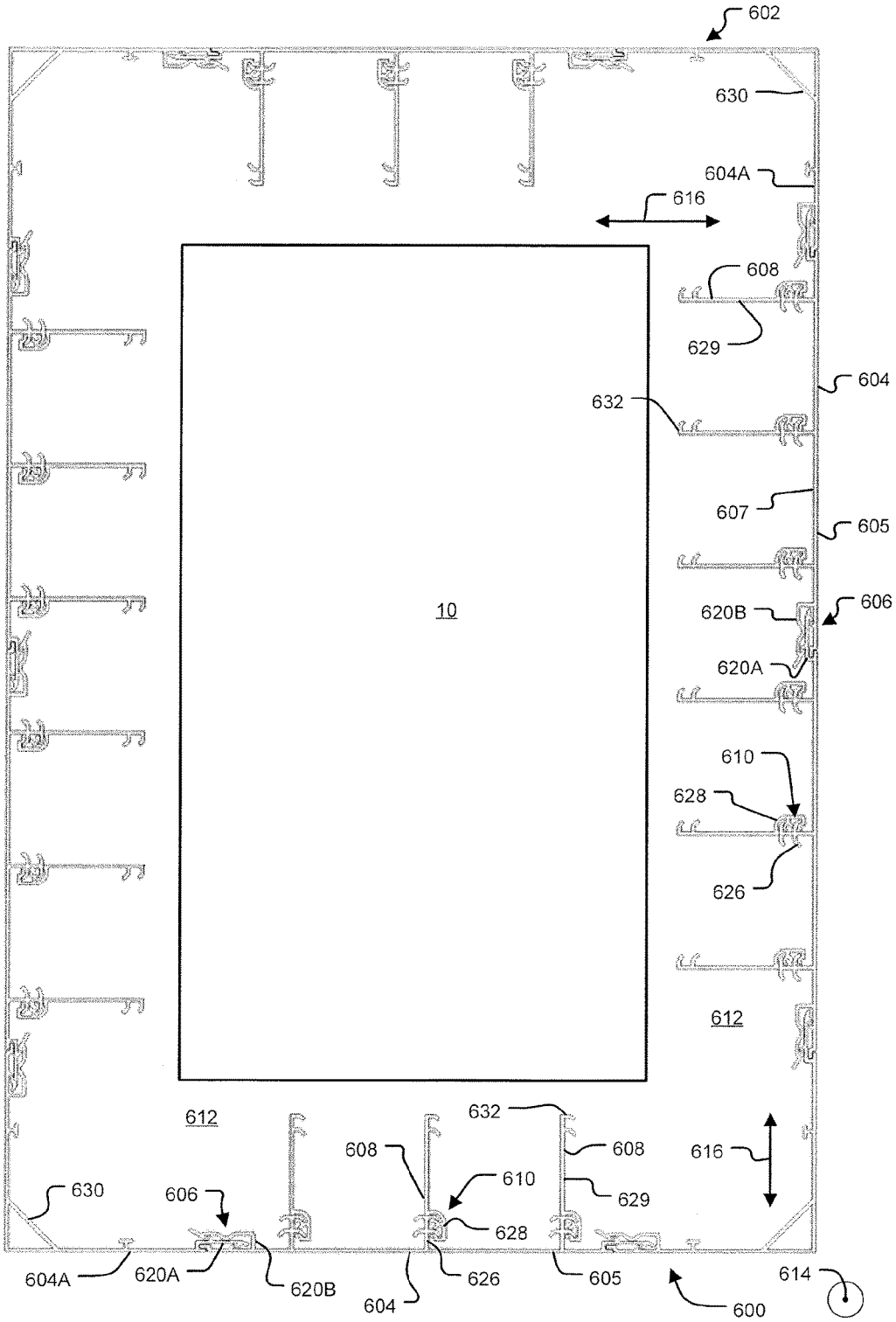
FIG. 7A is a cross-sectional plan view of a system for building a repair structure and thereby repairing the FIG. 1A existing structure according to another example embodiment.

FIG. 7A is a cross-sectional plan view of a system 600 for building a repair structure 602 and thereby repairing existing structure 10 (FIG. 1A) according to another example embodiment. For simplicity, damaged regions 16 of existing structure 10 are not shown in FIG. 7A. System 600 is similar in many respects to systems 200 and 400 described above and similar reference numbers are used to refer to similar components, except that the reference numbers of system 600 are preceded by the numeral "6", whereas the reference number of systems 200 and 400 are preceded by the numerals "2" and "4" respectively. System 600 comprises: a plurality of panels 604 connected to one another in edge-adjacent relationship by connections 606; and a plurality of standoffs 608 connected to panels 604 (at connections 610) and extending away from interior surfaces 607 of panels 604 toward existing structure 10. Panels 604 extend in a longitudinal direction 614 (into and out of the page in FIG. 7A) and in transverse directions 616 (in the plane of the page in FIG. 7A) to provide exterior surfaces 605 and interior surfaces 607. In the illustrated embodiment, system 600 also comprises a plurality of outside corner panels 604A which are substantially similar to outside corner panels 204A described above. In other embodiments, outside corner panels similar to outside corner panels 304A (FIG. 3) could be used in the place of outside corner panels 604A. Repair structure 602 is formed when concrete (or some other curable material) is introduced into space 612 between panels 604 and existing structure 10. Extension of standoffs 608 into space 612 anchors panels 604 to the curable material as it cures, thereby providing repair structure 602 with a cladding.

Panels 604 of system 600 are similar to panels 204 of system 200 in that panels 604 are generally planar and comprise connector components 620A, 620B at their respective transverse ends which connect to one another to provide edge-adjacent panel connections 606 which connect panels 604 in edge-adjacent relationship in a manner substantially identical to connector components 220A, 220B and edge-adjacent panel connections 206 described above. Connections between edge-adjacent panels 604 may additionally or alternatively implemented according to any of the variations described above.

Panels 604 of system 600 differ from panels 204 of system 200 in that panels 604 comprise panel connector components 626 which are shaped differently and function differently than panel connector components 226. Like panel connector components 226, panel connector components 626 are complementary to standoff connector components 628 of standoffs 608 to provide connections 610 therebetween. Panel connector components 626, which interact with standoff connector components 628 to provide connections 610, are described in more detail below. Like panels 204 of system 200, panels 604 of system 600 comprise three panel connector components 626, although this is not necessary. In general, panels 604 of system 600 may be provided with any suitable transverse widths (including a variety of different transverse widths) and may be provided with any suitable number of panel connector components 626 which may depend on the transverse widths of the corresponding panel 604 and on the requirements and/or specifications of a particular application.

System 600 also comprises standoffs 608 that are similar in many respects to standoffs 208 described above in that standoffs 608 connect to panels 604 at connections 610 and extend in longitudinal direction 614 and away from interior surfaces 607 of panels 604 toward existing structure 10. As is the case with standoffs 208 described above, the longitudinal 614 dimensions of standoffs 608 may be less than the corresponding longitudinal dimensions of panels 604. Standoffs 608 having longitudinal dimensions less than those of panels 604 may be "located" relative to panels 604 in accordance with any of the patterns or arrangements discussed above for standoffs 208 relative to panels 204. In some embodiments, the longitudinal dimensions of standoffs may be coextensive with the longitudinal dimensions of panels.

Standoffs 608 of the FIG. 7A embodiment are not expressly shown with rebar-chair concavities, but it will be appreciated that generally planar shafts 629 of standoffs 608 could be modified (e.g. by punching) to provide rebar-chair concavities. Standoffs 608 may be solid (i.e. non-apertured) or apertured in a manner similar to that discussed above for standoffs 208.

Standoffs 608 of the FIG. 7A embodiment comprise optional heads 632 which are different from optional heads 232 of standoffs 208. Optional heads 632 extend longitudinally 614 and transversely 616 and may function to anchor standoffs 608 (and thereby panels 604) in the curable material once it cures and to disperse some of the forces which may occur if and when standoffs 608 abut against existing structure 10 in a manner similar to optional heads 232 of standoffs 208. However, optional heads 632 differ from optional heads 232 in that optional heads 632 have a shape that is substantially similar to the shape of a portion of panel connector components 626. This shape of optional heads 632 permits stacking multiple standoffs 608 to one another, as described in more detail below.

Standoffs 608 also comprise standoff connector components 628 which are shaped differently and which function differently than standoff connector components 228 of standoffs 208. Like standoff connector components 228, standoff connector components 628 are complementary to panel connector components 626 of panels 604 to provide connections 610 therebetween. Connections 610 share a number of similarities with connections 210 described above. More particularly, connections 610 between panel connector components 626 and standoff connector components 628 involve the creation of restorative deformation forces which tend to hold standoffs 608 in place relative to panels 604—i.e. to permit standoffs 608 to be "locatable" anywhere along the longitudinal 614 dimensions of panel connector components 626 and panels 604. For example, in cases where the longitudinal direction 614 is at least partially vertically oriented, the restorative deformation forces created in connections 610 may prevent standoffs 608 from moving (e.g. sliding) longitudinally along panel connector components 626 under the force of gravity. In some embodiments, these restorative deformation forces created when forming connections 610 may be sufficient to support the weight of both standoffs 608 and rebar supported thereon.

Figure 7B:
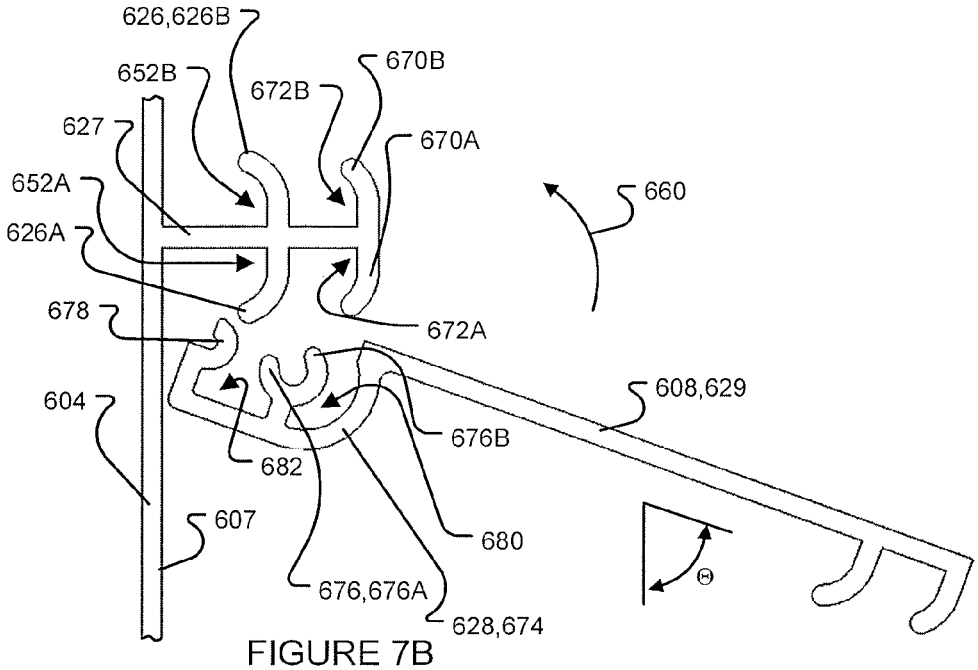
FIGS. 7B-7D show magnified cross-sectional views of the process of coupling a panel connector component of a panel of the FIG. 7A system to a standoff connector component of a standoff of the FIG. 7A system.

Panel connector components 626, standoff connector components 628 and the formation of connections 610 between panel connector components 626 and standoff connector components 628 are now described in more detail with reference to FIGS. 7B-7D. As can be seen from FIGS. 7B to 7D, panel connector component 626 comprises: a planar central shaft 627 which extends inwardly from interior surface 607 of panel 604; a first, proximate pair of hooked arms 626A, 626B which extend transversely from a first, proximate location on shaft 627 spaced apart from interior surface 607 of panel 604 and curve back toward interior surface 607 to provide corresponding first, proximate hook concavities 652A, 652B; and a second, distal pair of hooked arms 670A, 670B which extend transversely from a second, distal location on shaft 627 spaced apart from interior surface 607 of panel 604 and curve back toward interior surface 607 to provide corresponding second, distal hook concavities 672A, 672B. Hooked arms 626A, 626B and hooked arms 670A, 670B may be symmetrical with respect to central shaft 627. Standoff connector component 628 comprises: a principal arm 674 which may be curved and which extends transversely away from its generally planar shaft 629 on one transverse side of planar shaft 629; a first, proximate finger 676 which may be curved and which extends from principal arm 674 back toward shaft 629 to define a first, proximate concavity 680 between first finger 676 and principal arm 674; and a second, distal finger 678 which may be curved and which extends from principal arm 674 to define a second, distal concavity 682 between first finger 676, second finger 678 and principal arm 674. In the illustrated embodiment, first finger 676 is split into a pair of spaced apart branches 676A, 676B, but this is not necessary.

Figure 7C:
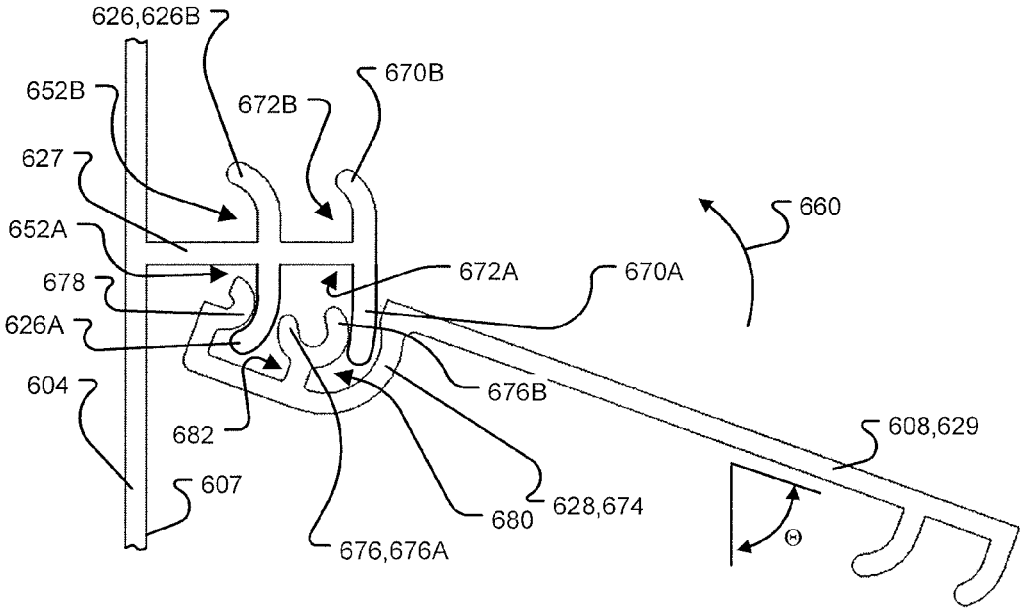
Figure 7D:
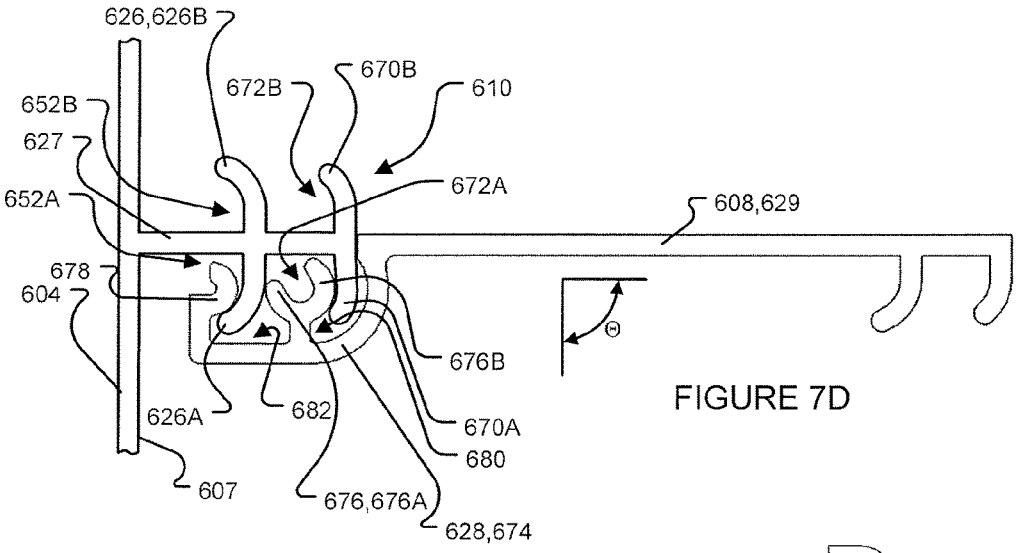

As seen best from FIG. 7D, connection 610 is made when:

- first hooked arm 626A of panel connector component 626 extends into and terminates in second concavity 682 of standoff connector component 628;
- second hooked arm 670A of panel connector component 626 extends into and terminates in first concavity 680 of standoff connector component 628;
- first finger 676 of standoff connector component 628 extends into and terminates in second hook concavity 672A of panel connector component 626; and
- second finger 678 of standoff connector component 628 extends into and terminates in first hook concavity 652A of panel connector component 626.

The process of coupling panel connector component 626 to standoff connector component 628 involves forcing relative pivotal motion between panel 604 and standoff 608—e.g. forcing standoff 608 to pivot relative to panel 604 in direction 660. Coupling panel connector component 626 to standoff connector component 628 involves initially aligning standoff 608 relative to panel 604 at a suitable initial angle θ (FIG. 7B) between the transverse extension of panel 604 and the extension of generally planar shaft 629 of standoff 608. In some embodiments, the initial angle θ may be in a range of 0°-80°. In some embodiments, the initial angle θ may be in a range of 30°-80°. Next, hooked arms 652A, 670A of panel connector component 626 are respectively partially extended into concavities 682, 680 of standoff connector component 628 and fingers 676, 678 of standoff connector component are respectively extended partially into hook concavities 672A, 652A of panel connector component 626 (FIG. 7C).

Relative pivotal motion is then effected (e.g. in direction 660) between panel 604 and standoff 608 (FIG. 7C). Because of the shape of connector components 626, 628 (i.e. hooked arms 652A, 670A and hook concavities 652A, 672A of panel connector component 626 and principal arm 674, fingers 676, 678 and concavities 680, 682 of standoff connector component 628), continued application of torque which causes relative pivotal motion between panel 604 and standoff 608 (e.g. in direction 660) causes corresponding deformation of one of more of: hooked arms 652A, 670A of panel connector component 626, principal arm 674 of standoff connector component 628 and fingers 676, 678 of standoff connector component 628. For example, the continued insertion of hooked arms 652A, 670A of panel connector component 626 into concavities 682, 680 of standoff connector component 628 may deform principal arm 674 and/or fingers 676, 678 of standoff connector component 628 to spread them further apart from one another (e.g. to enlarge concavities 682, 680). Hooked arms 652A, 670A may be similarly deformed.

With further relative pivotal motion (e.g. in direction 660) between panel 604 and standoff 608, the connected configuration 610 of FIG. 7D is achieved. Connector components 626, 628 are shaped such that between the configuration of FIG. 7C and the connected configuration of FIG. 7D, restorative deformation forces (e.g. elastic forces which tend to restore hooked arms 652A, 670A, principal arm 674 and/or fingers 676, 678 to their original (non-deformed) states) cause hooked arms 652A, 670A, principal arm 674 and/or fingers 676, 678 to move back toward their non-deformed states. However, even in the formation of connection 610 (FIG. 7D) the restorative deformation forces associated with the deformation of hooked arms 652A, 670A, principal arm 674 and/or fingers 676, 678 are maintained—i.e. after the formation of connection 610, hooked arms 652A, 670A, principal arm 674 and/or fingers 676, 678 are not restored to their original non-deformed state, resulting in the existence of restorative deformation forces after the formation of connection 610. As discussed above, these restorative deformation forces allow standoffs 608 to be "located" anywhere along the longitudinal 614 dimension of panels 604. In particular embodiments, these restorative deformation forces are sufficient to permit standoffs 608 to be located without substantial movement under the force of gravity acting on standoffs 608. In some embodiments, these restorative deformation forces are sufficient to permit standoffs 608 to also support rebar without substantial movement under the force of gravity acting standoffs 608 and the supported rebar.

The "locatability" of standoffs 608 at various locations along panels 604 can add versatility to the process of fabricating system 600. For example, in some applications, standoffs 608 may be connected to panels 604 using connections 610 at desired locations prior to connecting panels 604 to one another in edge-adjacent relationship at connections 606. In other applications, standoffs 608 may be connected to panels 604 using connections 610 at desired locations after connecting panels 604 to one another in edge-adjacent relationship at connections 606. The order of assembly of connections 610 and connections 606 may depend on the particular circumstances of a given application. It will be appreciated though that added versatility is advantageous, because spatial constraints of particular applications may make it difficult to assemble system 600 in one order versus the other. Another advantage of the locatability of standoffs 608 at various locations along panels 604 is that standoffs 608 need not be connected to existing structure 10 prior to or after making connections 610.

Connections 610 between standoff connector components 628 and panel connector components 626 have the additional advantage that if it is desired to disconnect a connection 610, force may be exerted on standoff 608 to exert torque that would tend to cause relative pivotal motion between standoff 608 and panel 604 (e.g. in a direction opposite direction 660). Such torque can deform one or both of connector components 626, 628 to thereby disconnect connection 610 and allow standoff 608 to be re-"located" at another desired location.

It will be appreciated that panel connector component 626 is symmetrical about its planar shaft 627. Consequently, standoff 608 may be reversed, so that standoff connector component 628 can be connected to panel connector component 626 by relative pivotal movement in the opposite direction to that shown in FIGS. 7B-7D. Where standoff 608 is reversed in this manner, connection 610 is made when:

- first hooked arm 626B of panel connector component 626 extends into and terminates in second concavity 682 of standoff connector component 628;
- second hooked arm 670B of panel connector component 626 extends into and terminates in first concavity 680 of standoff connector component 628;
- first finger 676 of standoff connector component 628 extends into and terminates in second hook concavity 672B of panel connector component 626; and
- second FIG. 678 of standoff connector component 628 extends into and terminates in first hook concavity 652B of panel connector component 626.

It will be appreciated that the ability to reverse standoffs 608 and to connect standoff connector components 628 to panel connector components 626 using relative pivotal movement in either direction increases the flexibility of assembly of system 600 and can be particularly useful in circumstances where physical constraints impede forming the connection from one side.

In other respects, system 600 may be similar to system 200 (e.g. panels 604 may be similar to panels 204 and standoffs 608 may be similar to standoffs 208 described herein).

Figure 8:
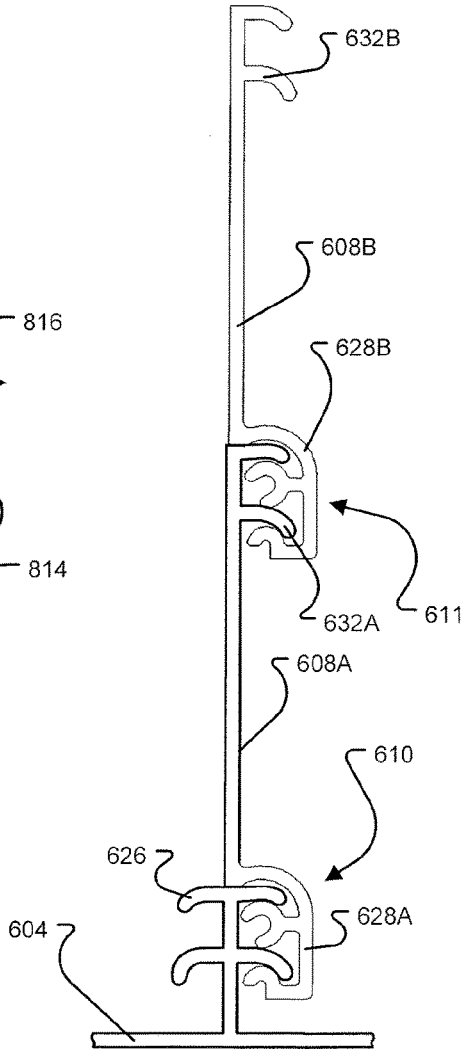
FIG. 8 is a cross-sectional plan view of a pair of stacked standoffs according to a particular embodiment.

FIG. 8 is a cross-sectional plan view of a pair of stacked standoffs 608A, 608B (together standoffs 608) which depict an additional feature of standoffs 608. Like standoffs 408 described above, standoffs 608 comprise a head 632 which has a shape similar to the operational portion of panel connector components 626 of panels 604. This permits a plurality of standoffs 608 to be stacked to one another as shown in FIG. 8. In the particular case of the FIG. 8 example, a first connection 610 is made between panel connector component 626 and standoff connector component 628A of standoff 608A and a second connection 611 is made between head 632A of standoff 608A and standoff connector component 628B of standoff 608B. If desired, an additional standoff 608 could be connected to head 632B of standoff 608B. It will be appreciated that the ability to stack pluralities of standoffs 608 together provides additional versatility for fabricating repair structures—e.g. where it is desired to provide a repair structure having different depths at different locations.

In the above described embodiments, systems for building repair structures are shown extending all of the way around an existing structure. For example, system 400 shown in FIGS. 4A and 4B extends all the way around existing structure 10. In general, this is not necessary. In some applications, it may be desirable to repair or to clad a portion of an existing structure. In some applications, it may be desirable to clad a newly formed independent structure (for example, where there need not be an existing structure). In such applications, the systems described herein may be provided as claddings which line interior surfaces (or portions of interior surfaces) of other supportive and removable formworks. Such claddings may be anchored to curable materials as they are permitted to cure within the supportive and removable formworks.

Figure 9:
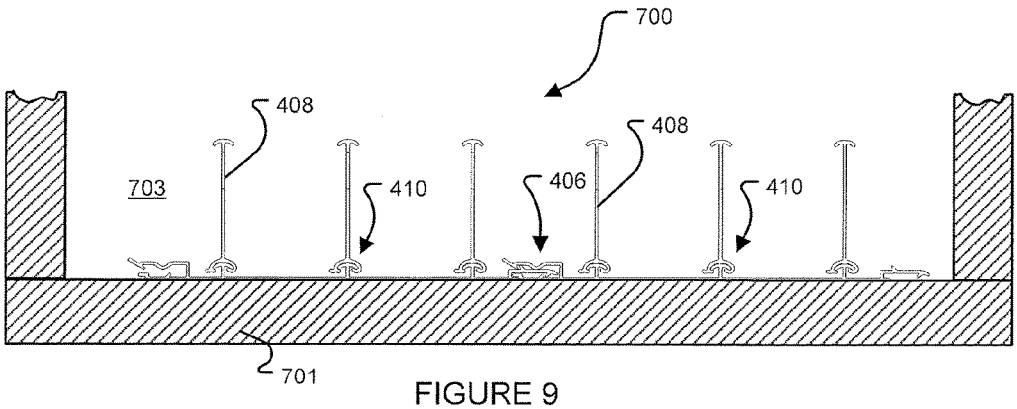
FIG. 9 is a cross-sectional plan view of a cladding system for cladding a structure according to a particular example embodiment.

FIG. 9 is a cross-sectional plan view of a cladding system 700 for cladding a structure according to an example embodiment. Cladding system 700 of the illustrated embodiment incorporates panels 404, standoffs 408, edge-adjacent panel connections 406 and panel-to-standoff connections 410 that are substantially similar to those described above for system 400 (FIGS. 4A-4F). Instead of going all of the way around an existing structure, however, cladding system 700 is constructed to line a portion of the interior surface of a supportive and removable formwork 701. For simplicity, only a portion of formwork 701 is shown in FIG. 9. In some applications, cladding system 700 could be made to line an entirety of the interior surface of formwork 701. Rebar may optionally be added within formwork 701 and may optionally be supported in whole or in part by standoffs 408. Concrete or other curable material may then be introduced into the formwork (e.g. in space 703) and permitted to cure therein. When the curable material is cured, formwork 701 may be removed. Standoffs 408 will anchor or couple system 700 into the newly formed structure to provide the newly formed structure with a cladding.

It will be appreciated that the use of cladding system 700 to clad a portion of a repair structure represents a sub-case of using cladding system 700 to clad a portion of a newly formed structure—i.e. a repair structure is merely an example of a newly formed structure. Cladding system 700 may also be used to clad the entirety of a new structure (including a repair structure). The FIG. 9 cladding system 700 comprises panels 404 and standoffs 408 that are substantially similar to those of system 400. It will be appreciated by those skilled in the art that cladding systems similar to that of cladding system 700 could be constructed using any suitable combinations of panels and standoffs described herein.

Figure 10A:
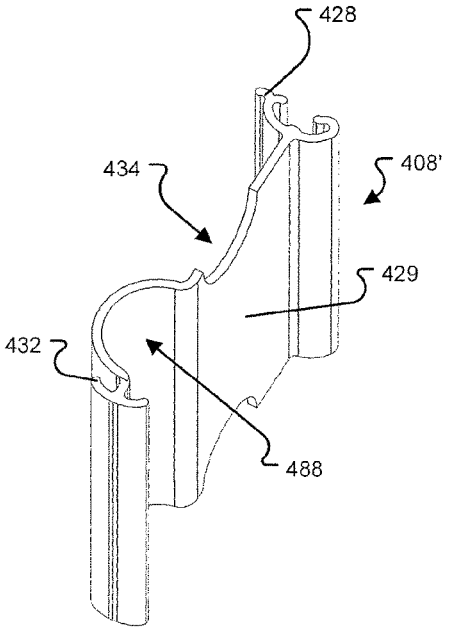
FIG. 10A is an isometric view of a standoff according to another embodiment which incorporates a pair of rebar-holding concavities.

FIG. 10A is an isometric view of a standoff 408' according to another embodiment which incorporates a pair of rebar-holding concavities 434, 488. In most respects, standoff 408' is similar to standoff 408 described herein and includes standoff connector component 428, generally planar shaft 429 and optional head 432. Like standoff 408, standoff 408' also includes rebar-chair concavity 434 for supporting transversely oriented rebar. Standoff 408' differs from standoff 408 in that standoff 408' also comprises a second rebar-holding concavity 488 for holding rebar that is oriented longitudinally—i.e. generally orthogonally to the transversely oriented rebar held in rebar-chair concavity 434. In other respects, standoff 408' may be substantially similar to standoff 408 described herein.

Figure 10B:
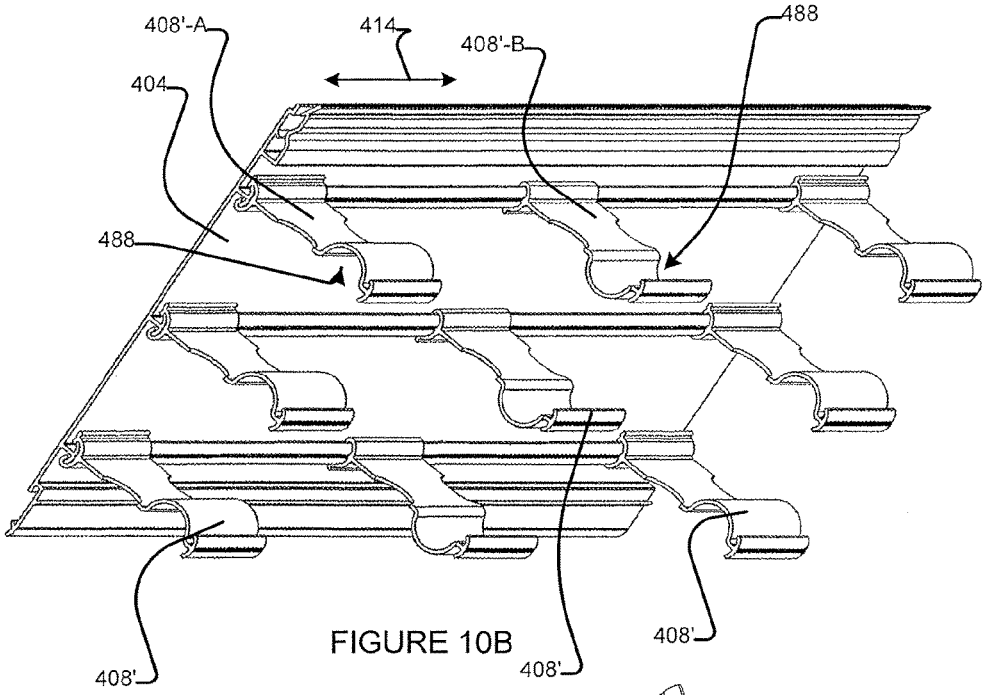
FIG. 10B is an isometric view of a plurality of the FIG. 10A standoffs connected to a panel in a particular exemplary configuration.
Figure 10C:
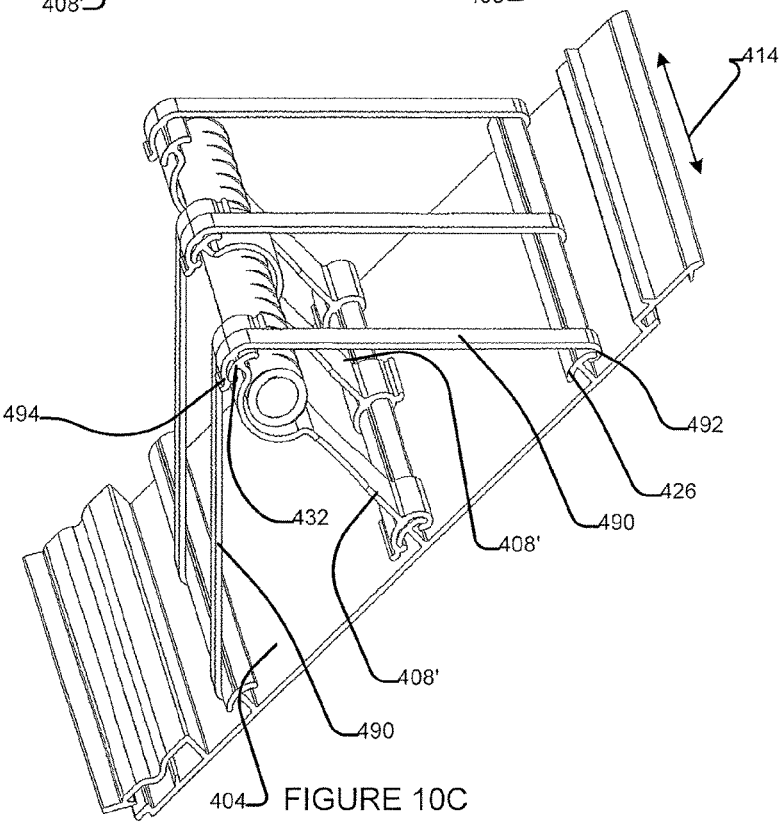
FIG. 10C is an isometric view of a plurality of the FIG. 10A standoffs connected to a panel in another exemplary configuration which comprises braces.

FIG. 10B is an isometric view of a plurality of standoffs 408' of the type shown in FIG. 10A connected to a panel 404 in a particular exemplary configuration. In the FIG. 10B configuration, longitudinally adjacent standoffs 408' (see exemplary standoffs 408'-A and 408'-B which (although spaced apart) are adjacent to one another in longitudinal direction 414) are connected to panel 404 with their rebar-holding concavities 488 oriented in opposing directions from one another to help hold both sides of the longitudinally oriented rebar. FIG. 10C is an isometric view of a plurality of standoffs 408' connected to a panel 404 in the same manner as shown in FIG. 10B to support a longitudinally oriented rebar from both sides. The FIG. 10C embodiment also comprises braces 490 which help to keep the longitudinally oriented rebar in place in rebar holding concavities 488. Braces 490 comprise hooks 492 for connecting to adjacent panel connector components 426 on panel 404 and hooks 494 for connecting to heads 432 of standoffs 408'.

Figure 10D:
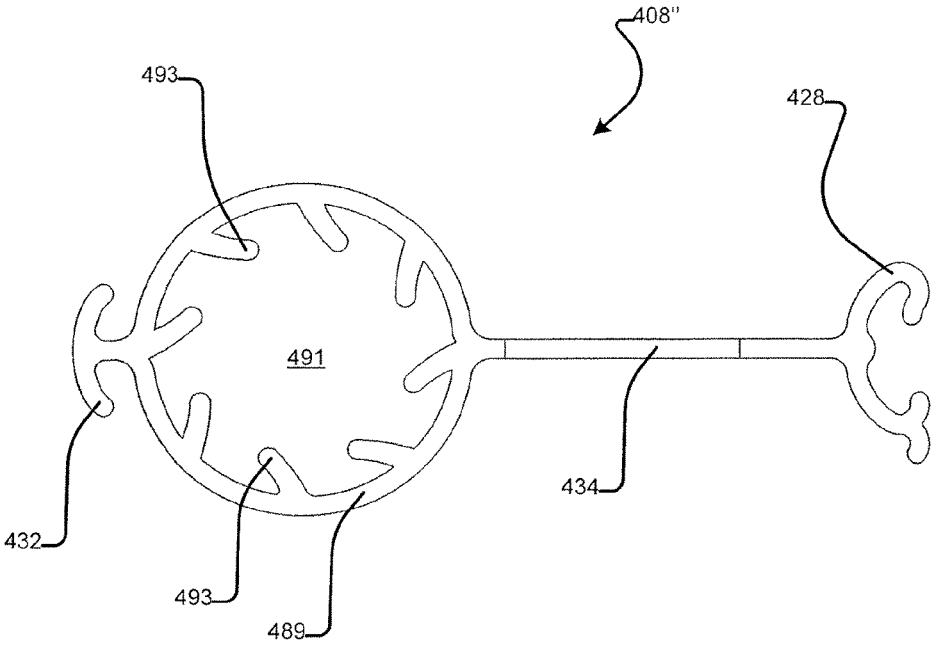
FIG. 10D is an plan view of a standoff according to another embodiment which incorporates a rebar-holding concavity for holding transversely oriented rebar and a second rebar-holding feature for holding vertically oriented rebar.

FIG. 10D is an isometric view of a standoff 408" according to another embodiment which incorporates a pair of rebar-holding features 434, 489. In most respects, standoff 408" is similar to standoff 408 described herein and includes standoff connector component 428, generally planar shaft 429 and optional head 432. Like standoff 408, standoff 408" comprises a rebar-chair concavity 434 for supporting transversely oriented rebar. Standoff 408" also comprises a rebar-holding feature 489 which defines a longitudinally oriented aperture 491 for holding longitudinally oriented rebar (longitudinal being into and out of the page in FIG. 10D). In the illustrated embodiment, rebar-holding feature 489 also comprises optional deformable fingers 493 which extend into aperture 491 and which may deform upon insertion of rebar through aperture 491 to exert restorative deformation forces on the rebar. In other respects, standoff 408' may be substantially similar to standoff 408 described herein.

Figure 10E:
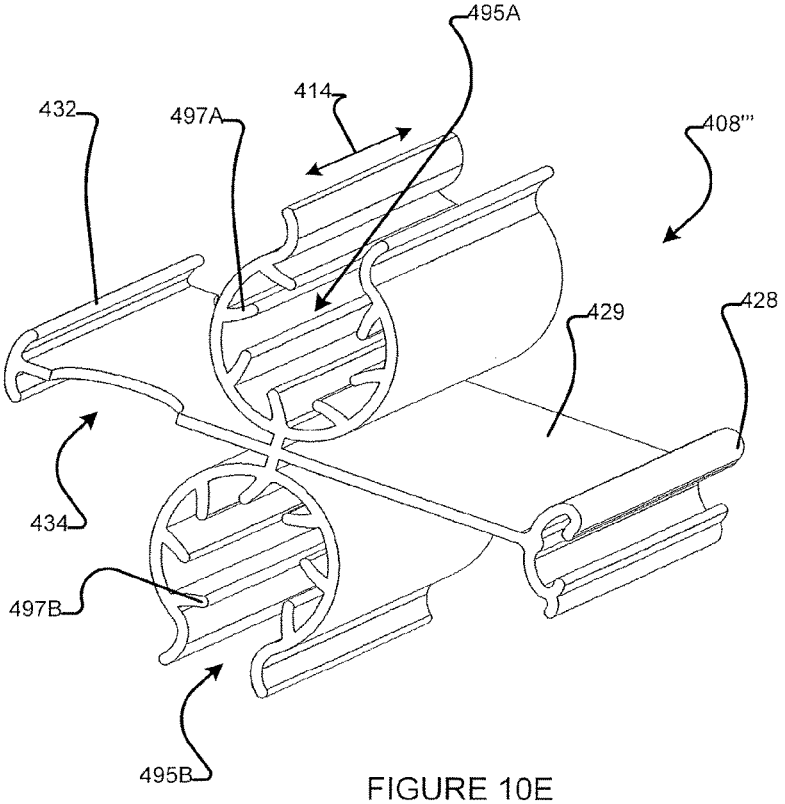
FIG. 10E is an isometric view of a standoff according to another embodiment which incorporates a rebar-holding concavity for holding transversely oriented rebar and a pair of second rebar-holding features for holding a pair of vertically oriented rebars.

FIG. 10E is an isometric view of a standoff 408''' according to another embodiment. Standoff 408''' incorporates three rebar-holding features 434, 495A, 495B. In most respects, standoff 408''' is similar to standoff 408 described herein and includes standoff connector component 428, generally planar shaft 429 and optional head 432. Like standoff 408, standoff 408''' comprises a rebar-chair concavity 434 for supporting transversely oriented rebar. Standoff 408''' also comprises a pair of rebar-holding concavities 495A, 495B for holding longitudinally oriented rebar (longitudinal being oriented in the direction of arrow 414 in FIG. 10E). In the illustrated embodiment, rebar-holding concavities 495A, 495B comprise optional deformable fingers 497A, 497B which extend into concavities 495A, 495B and which may deform upon insertion of rebar into concavities 495A, 495B to exert restorative deformation forces on the rebar. As can be seen from the illustrated embodiment of FIG. 10E, the openings of rebar-holding concavities 495A, 495B have dimensions smaller than the interiors of concavities 495A, 495B. Accordingly, insertion of rebar into concavities 495A, 495B may involve deforming the arms which define concavities 495A, 495B. Consequently, the arms of concavities 495A, 495B may also exert restorative deformation forces on rebar located in concavities 495A, 495B. Such restorative deformation forces may help to retain rebar in concavities 495A, 495B. In other respects, standoff 408''' may be substantially similar to standoff 408 described herein.

Figure 11:
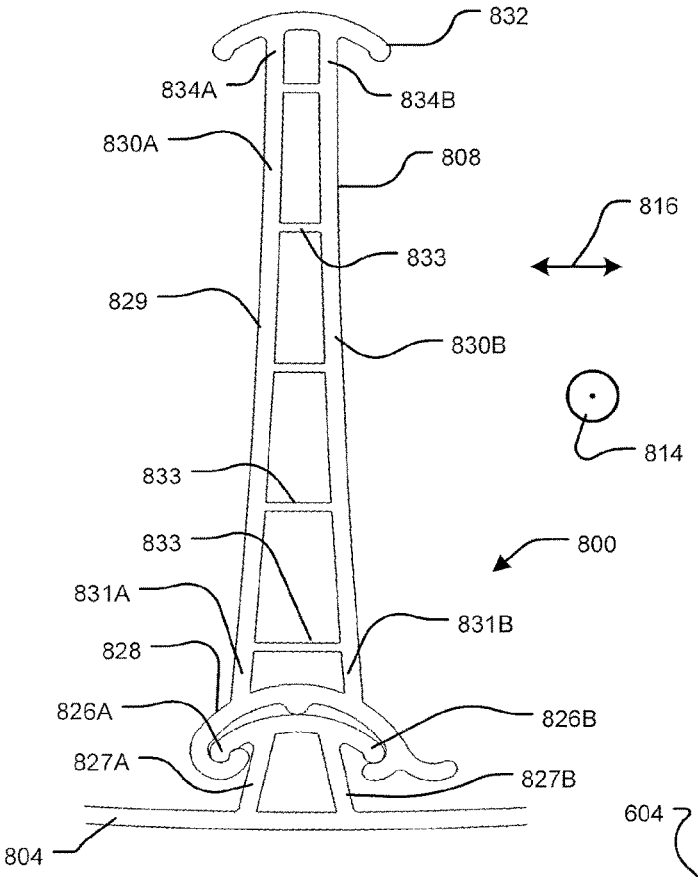
FIG. 11 is a cross-sectional plan view of a system for building a repair structure according to a particular embodiment.

FIG. 11 is a partial cross-section plan view of a system 800 for building a repair structure according to another embodiment which comprises a standoff 808 and a panel 804. Standoff 808 is similar in many respects to standoffs 408 described above. Other than shaft 829 (described below), standoff 808 may be substantially similar to standoff 408. Similarly, other than panel connector component 826, panel 804 may be substantially similar to panel 404. As is the case with standoffs 208, 408, etc. described above, the longitudinal 814 dimensions of standoffs 808 may be less than the corresponding longitudinal dimensions of panels 804. Standoffs 808 having longitudinal dimensions less than those of panels 804 may be "located" relative to panels 804 in accordance with any of the patterns or arrangements discussed above for standoffs 208 relative to panels 204. In some embodiments, the longitudinal dimensions of standoffs 808 may be coextensive with the longitudinal dimensions of panels 804.

Standoff 808 differs from standoff 408 in that elongated shaft 829 comprises two transversely spaced apart stems 830A, 830B (transverse being the directions 816 in FIG. 11). Each stem 830A, 830B (collectively stems 830) may (but need not necessarily) be generally planar and extend between standoff connector component 828 at one of its edges and optional head 832 at its opposing edge. In the illustrated embodiment, stems 830 are slightly curved toward one another to form concave outward surface on each stem 830. Also, the transverse distance separating the proximal ends 831A, 831B of stems 830A, 830B at or near standoff connector component 828 is greater than the transverse distance separating distal ends 834A, 834B of stems 830A, 830B at or near head 832. Both the curved shape and the wider base 831 of stems 830 provide for greater structural integrity and strength of shaft 829. In other embodiments, stems 830 may have other shapes and may be curved away from one another, may be straight, or may have another appropriate shape.

In the illustrated embodiment, optional braces 833 extend between first stem 830A and second stem 830B. This configuration of braces 833 is not necessary. In other embodiments, braces 833 may extend between stems 830 at suitable angles—e.g. to form a plurality of triangles, such as in a truss. In still other embodiments, braces 833 may have other configurations, such as braces with varying widths, braces that extend only part way between stems 830, or the like. In some embodiments, braces 833 may not be present. In these embodiments, stems 830 may have a width such that a space is formed between stems 830 and stems 830 may be connected only at standoff connector 828 and an end opposite standoff connector 828 (such as optional head 832).

Stems 830 and braces 833 provide additional strength against shaft 829 being bent or deformed due to forces applied to shaft 829 by curable material (e.g. concrete) introduced into the system 800 or due to interaction between shaft 829 and an existing structure (not shown in FIG. 11). The additional strength may help to maintain the position and alignment of formwork system 800 when building a repair structure increasing the ease of use, reliability and precision of the system. The additional strength may also provide increased structural integrity and strength to the structures (e.g. repair structures or independent structures) into which standoffs 808 extend.

As mentioned, stems 830 extend from standoff connector component 828, which is connected to panel connector component 826. Panel connector component 826 differs from panel connector component 426 in that panel connector component 826 is coupled to panel 804 by way of two legs 827A, 827B (collectively, legs 827). In the illustrated embodiment, legs 827 are wider at their base where they connect to panel 808 than at their peak where they connect to hooked arms 826A, 826B. This provides a stable support for panel connector component 826 and still permits hooked arms 826A, 826B to form concavities 852A, 852B that are large enough to receive hooked arms 828A, 828B of standoff connector component 828.

Legs 827 provide panel connector component 826 with additional strength and stability relative to a single leg 827. This additional support facilitates standoffs 808 maintaining a desired alignment relative to panels 804. Legs 827 may increase the strength of panel connector component 826 by reducing the length of hooked arms 826A, 826B from legs 827 relative to the length of hooked arms 826A, 826B with a single leg. Shorter hooked arms 826A may result in relatively more resilient deformation of standoff connector component 828 (and less resilient deformation of panel connector component 826) when connection 810 between standoff connector component 828 and panel connector component 826 is formed.

Legs 827 may be configured differently than shown in FIG. 11. For example, a brace could be provided between legs 827, legs 827 could abut one another at their peak to form a V shape, legs 827 could be convex, legs 827 could be concave, or the like.

Those skilled in the art will appreciate that the hooked arms 826 of panel connector component 826 have the same shape as those of other panel connector components described herein (e.g. panel connector components 426) and that standoff connector component 828 and head 832 of standoff 808 have shapes similar to those of other standoff connector components and heads described herein (e.g. standoff connector components 408 and heads 432). Consequently, panels 804 incorporating panel connector components 826 may be used with other standoffs described herein (e.g. standoffs 408) and standoffs 808 may be used with other panels described herein (e.g. panels 404).

In currently preferred embodiments, system components such as panels 204, 404, etc., corner panels 204A, 404A etc., and standoffs 208, 408, etc. are fabricated from suitable plastic (e.g. polyvinyl chloride (PVC)) using an extrusion process. Standoffs 208, 408, etc. may optionally be punched to provide rebar-chair concavities 234, 434 and/or apertures. It will be understood, however, that system components could be fabricated from other suitable materials, such as, by way of non-limiting example, other suitable plastics, other suitable metals or metal alloys, polymeric materials, fibreglass, carbon fibre material or the like and that cladding system components described herein could be fabricated using any other suitable fabrication techniques, such as (by way of non-limiting example) injection molding, pultrusion.

Where a component is referred to above (e.g., a panel, a standoff and/or features of panels and/or standoffs), unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Unless the context clearly requires otherwise, throughout the description, the aspects and the claims (if present), the words "comprise," "comprising," and the like are to be construed in an inclusive sense, as opposed to an exclusive or exhaustive sense; that is to say, in the sense of "including, but not limited to." Where the context permits, words in the above description using the singular or plural number may also include the plural or singular number respectively. The word "or," in reference to a list of two or more items, covers all of the following interpretations of the word: any of the items in the list, all of the items in the list, and any combination of the items in the list.

The above detailed description of example embodiments is not intended to be exhaustive or to limit this disclosure, aspects and claims (if present) to the precise forms disclosed above. While specific examples of, and examples for, embodiments are described above for illustrative purposes, various equivalent modifications are possible within the scope of the technology, as those skilled in the relevant art will recognize.

These and other changes can be made to the system in light of the above description. While the above description describes certain examples of the technology, and describes the best mode contemplated, no matter how detailed the above appears in text, the technology can be practiced in many ways. As noted above, particular terminology used when describing certain features or aspects of the system should not be taken to imply that the terminology is being redefined herein to be restricted to any specific characteristics, features, or aspects of the system with which that terminology is associated. In general, the terms used in the following claims (if present) should not be construed to limit the system to the specific examples disclosed in the specification, unless the above description section explicitly and restrictively defines such terms. Accordingly, the actual scope of the technology encompasses not only the disclosed examples, but also all equivalent ways of practicing or implementing the technology under the claims (if present).

From the foregoing, it will be appreciated that specific examples of apparatus and methods have been described herein for purposes of illustration, but that various modifications, alterations, additions and permutations may be made without departing from the practice of the invention. The embodiments described herein are only examples. Those skilled in the art will appreciate that certain features of embodiments described herein may be used in combination with features of other embodiments described herein, and that embodiments described herein may be practised or implemented without all of the features ascribed to them herein. Such variations on described embodiments that would be apparent to the skilled addressee, including variations comprising mixing and matching of features from different embodiments, are within the scope of this invention.

As will be apparent to those skilled in the art in light of the foregoing disclosure, many alterations and modifications are possible in the practice of this invention without departing from the spirit or scope thereof. For example:

System 500 described above is used to build a curved repair structure 502 using panels 404 and standoffs 408 which are similar to those of system 400. It will be appreciated that curved repair structures could also be fabricated using any suitable combination of panels and standoffs described herein, such as (by way of non-limiting example): panels 204 and standoffs 208 which are similar to those of system 200; panels 604 and standoffs 608 which are similar to those of system 600; and/or the like.

Systems according to various embodiments may be used to insulate structures. More particularly, insulation (e.g. rigid foam insulation and/or the like) may be placed adjacent the interior surfaces of panels (between standoffs) prior to the introduction of concrete. After placement of insulation in this manner, concrete or other curable material may be introduced (e.g. into the interior of a lining system on an interior of the insulation and/or into the space between the insulation and an existing structure). Provided that the standoffs extend inwardly beyond the insulation, the standoffs will act to anchor the panels and insulation to the newly formed structure when the curable material cures.

In the embodiments described above, one or more standoffs are connected to each panel connector component. This is not necessary. In general, standoffs may be placed in any suitable arrangement that may suit the needs of a particular application. The mere presence of panel connector components on a panel does not mandate that standoffs must be connected to such panel connector components.

In the embodiments described above, the shape of the repair structures conform generally to the shape of the existing structures. This is not necessary. In general, the repair structure may have any desired shape by constructing suitable panels and, optionally, suitable removable bracing or formwork. For example, the cross-section of existing structure 110 (FIG. 1B) is generally round in shape, but a system having a rectangular-shaped cross-section (e.g. system 400) may be used to repair existing structure 110. Similarly, the cross-section of existing structure 10 (FIG. 1A) is generally rectangular in shape, but a system having a circular shaped cross-section (e.g. system 500) may be used to repair existing structure 10. Furthermore, it is not necessary that a repair structure go all of the way around a perimeter of an existing structure. Repair structures according to some embodiments may cover a portion (e.g. a portion of a perimeter) of an existing structure.

The embodiments described above describe the use of systems which have particular shapes in cross-section. These particular shapes are intended to be demonstrative and non-limiting. It will be appreciated that systems similar to those described above can be constructed using suitably curved panels and/or suitable inside and/or outside corner panels to provide any arbitrary shape. Particular embodiments of the invention should be understood to include systems constructed to have arbitrary shapes.

Some of the embodiments described above comprise rebar-holding concavities or other rebar-holding features. Such concavities and/or other rebar-holding features can be used to hold other items, such as, by way of non-limiting example, anodic corrosion control components and/or devices intended to reduce the rate of corrosion of rebar and/or the like. Any description contained herein of holding rebar may be similarly configured to hold anodic corrosion control components. Non-limiting examples of such corrosion control components include those manufactured by Vector Corrosion Technologies, Inc. of Winnipeg, Manitoba, Canada.

Systems described herein are disclosed to involve the use of concrete as an example of a curable material. It should be understood by those skilled in the art that in other embodiments, other curable materials could be used in addition to or as an alternative to concrete. By way of non-limiting example, systems described herein could be used to contain a structural curable material similar to concrete or some other curable material (e.g curable foam insulation, curable protective material or the like).

Surfaces of existing structures may be uneven (e.g. due to damage or to the manner of fabrication and/or the like). In some embodiments, suitable spacers, shims or the like may be used to space standoffs apart from the uneven surfaces of existing structures. Such spacers, shims or the like, which are well known in the art, may be fabricated from any suitable material including metal alloys, suitable plastics, other polymers, wood composite materials or the like.

In some applications, the lining systems (panels and standoffs) described herein can increase the structural integrity of a structure (e.g. a repair structure or an independent structure) formed from curable material in which the standoffs are embedded. This is particularly the case, for example, when standoffs are made of structural materials or other relatively strong materials and/or when standoffs are fabricated using techniques like pultrusion.

It will be understood that directional words (e.g. vertical, horizontal and the like) may be used herein for the purposes of description of the illustrated exemplary applications and embodiments. However, the methods and apparatus described herein are not limited to particular directions or orientations and may be used for repairing and/or cladding structures having different orientations. As such, the directional words used herein to describe the methods and apparatus of the invention will be understood by those skilled in the art to have a general meaning which is not strictly limited and which may change depending on the particular application.

The systems described herein are not limited to repairing existing concrete structures. By way of non-limiting example, apparatus described herein may be used to repair existing structures comprising concrete, brick, masonry material, wood, metal, steel, other structural materials or the like.

It may be desired in some applications to change the dimensions of (e.g. to lengthen a dimension of) an existing structure. By way of non-limiting example, it may be desirable to lengthen a pilaster or column or the like in circumstances where the existing structure has sunk into the ground. Particular embodiments of the invention may be used to achieve such dimension changes by extending the apparatus beyond an edge of the existing structure, such that the repair structure, once formed effectively changes the dimensions of the existing structure.

In some applications, repair structures may be fabricated in stages. For example, a first portion of a repair structure may be constructed and permitted to cure in a first stage and a second portion of a repair structure may be subsequently constructed and permitted to cure. In some circumstances, the second portion of the repair structure may overlap part of (or all of) the first portion of the repair structure.

While a number of exemplary aspects and embodiments have been discussed above, those of skill in the art will recognize certain modifications, permutations, additions and sub-combinations thereof. It is therefore intended that the following appended aspects and aspects hereafter introduced should not be limited by the preferred embodiments and should be interpreted to include all such modifications, permutations, additions and sub-combinations as are within the broadest interpretation consistent with the description as a whole.

What is claimed is:

1. An apparatus for covering at least a portion of a surface of an existing structure with a repair structure, the apparatus comprising:

a plurality of longitudinally and transversely extending panels connected to one another in edge-adjacent relationship; and a plurality of standoffs connected to the panels and extending from the panels toward the existing structure;

wherein:

each panel comprises an exterior surface and an opposing interior surface on a side of the panel closer to the existing structure;

each panel comprises a panel connector component which extends longitudinally along the panel and from the interior surface of the panel toward the existing structure, and each standoff comprises a standoff connector component complementary to the panel connector component, the panel and standoff connector components shaped such that a connection formed therebetween comprises deformation of at least one of the panel connector component and the standoff connector component;

the panel connector component and standoff connector component are shaped such that the connection is formed therebetween by force directed to create relative movement between the standoff and the panel in a direction generally orthogonal to the interior surface of the panel at the location of the panel connector component;

each of the plurality of panel connector components comprises a pair of panel hooked arms which extend away from the interior surface of the panel and which curve back toward the interior surface of the panel at distal ends of the panel hooked arms to provide corresponding panel hook concavities; and each of the plurality of standoff connector components comprises a pair of standoff hooked arms which extend away from a shaft of the standoff and which curve back toward the shaft of the standoff at distal ends of the standoff hooked arms to provide corresponding standoff hook concavities.

2. An apparatus according to claim 1 wherein each connection between a corresponding panel connector component and a corresponding standoff connector component comprises at least one of the pair of panel hooked arms extending into and terminating in the standoff hook concavity of a corresponding one of the pair of standoff hooked arms and the corresponding one of the pair of standoff hooked arms extending into and terminating in the panel hook concavity of the at least one of the pair of panel hooked arms.

3. An apparatus according to claim 1 wherein the standoff connector components comprise beveled standoff surfaces which extend transversely toward one another as the beveled standoff surface extend toward the shaft of the standoff and wherein the panel connector components comprise beveled panel surfaces which extend transversely toward one another as the beveled panel surfaces extend away from the interior surface of the panel.

4. An apparatus according to claim 3 wherein, upon application of the force directed to create relative movement between the standoff and the panel in the direction generally orthogonal to the interior surface of the panel, abutment between the beveled standoff surfaces and the beveled panel surfaces and causes the deformation of at least one of the panel connector component and the standoff connector component.

5. An apparatus according to claim 3 wherein: for each panel connector component, the pair of panel hooked arms is shaped to provide the beveled panel surfaces; and, for each standoff connector component, the pair of standoff hooked arms is shaped to provide the beveled standoff surfaces.

6. An apparatus according to claim 1 comprising curable material introduced into a space between the interior surface of the panels and the existing structure and permitted to cure to provide the repair structure cladded at least in part by the panels.

7. An apparatus according to claim 6 wherein the standoffs are shaped to extend into the space into which the curable material is introduced for anchoring the panels to the curable material as it cures to thereby provide the cladding.

8. An apparatus according to claim 1 wherein the deformation of the at least one of the panel connector component and the standoff connector component for each connection therebetween results in restorative deformation forces that prevent relative movement between the panel and the standoff under the force of gravity.

9. An apparatus according to claim 1 wherein, for each standoff connector component, the pair of standoff hooked arms are transversely spaced apart from one another and wherein, for each connection between the corresponding panel connector component and the corresponding standoff connector component, the deformation of the at least one of the panel connector component and the standoff connector component comprises deformation of the standoff connector component and deformation of the standoff connector component comprises deformation of the pair of standoff hooked arms transversely apart from one another and then at least partial restoration of the pair of standoff hooked arms transversely toward one another.

10. An apparatus for covering at least a portion of a surface of an existing structure with a repair structure, the apparatus comprising:

a plurality of longitudinally and transversely extending panels connected to one another in edge-adjacent relationship; and a plurality of standoffs connected to the panels and extending from the panels toward the existing structure;

wherein:

each panel comprises an exterior surface and an opposing interior surface on a side of the panel closer to the existing structure;

each panel comprises a panel connector component which extends longitudinally along the panel and from the interior surface of the panel toward the existing structure, and each standoff comprises a standoff connector component complementary to the panel connector component, the panel and standoff connector components shaped such that a connection formed therebetween comprises deformation of at least one of the panel connector component and the standoff connector component;

the panel connector component and standoff connector component are shaped such that the connection is formed therebetween by force directed to create relative movement between the standoff and the panel in a direction generally orthogonal to the interior surface of the panel at the location of the panel connector component;

each of the plurality of panel connector components comprises a pair of panel hooked arms which extend away from the interior surface of the panel and which curve back toward the interior surface of the panel at distal ends of the panel hooked arms to provide corresponding panel hook concavities;

each of the plurality of standoff connector components comprises a pair of standoff hooked arms which extend away from a shaft of the standoff and which curve back toward the shaft of the standoff at distal ends of the standoff hooked arms to provide corresponding standoff hook concavities; and wherein, for each panel connector component, the pair of panel hooked arms are transversely spaced apart from one another and wherein, for each connection between a corresponding panel connector component and a corresponding standoff connector component, the deformation of the at least one of the panel connector component and the standoff connector component comprises deformation of the panel connector component and deformation of the panel connector component comprises deformation of the pair of panel hooked arms transversely toward one another and then at least partial restoration of the pair of panel hooked arms transversely away from one another.

11. An apparatus for covering at least a portion of a surface of an existing structure with a repair structure, the apparatus comprising:

a plurality of longitudinally and transversely extending panels connected to one another in edge-adjacent relationship; and a plurality of standoffs connected to the panels and extending from the panels toward the existing structure;

wherein:

each panel comprises an exterior surface and an opposing interior surface on a side of the panel closer to the existing structure;

each panel comprises a panel connector component which extends longitudinally along the panel and from the interior surface of the panel toward the existing structure, and each standoff comprises a standoff connector component complementary to the panel connector component, the panel and standoff connector components shaped such that a connection formed therebetween comprises deformation of at least one of the panel connector component and the standoff connector component;

the panel connector component and standoff connector component are shaped such that the connection is formed therebetween by force directed to create relative movement between the standoff and the panel in a direction generally orthogonal to the interior surface of the panel at the location of the panel connector component;

each of the plurality of panel connector components comprises a pair of panel hooked arms which extend away from the interior surface of the panel and which curve back toward the interior surface of the panel at distal ends of the panel hooked arms to provide corresponding panel hook concavities;

each of the plurality of standoff connector components comprises a pair of standoff hooked arms which extend away from a shaft of the standoff and which curve back toward the shaft of the standoff at distal ends of the standoff hooked arms to provide corresponding standoff hook concavities; and wherein, for each standoff connector component, the pair of standoff hooked arms are transversely spaced apart from one another and wherein, for each connection between a corresponding panel connector component and a corresponding standoff connector component, the deformation of the at least one of the panel connector component and the standoff connector component comprises deformation of the panel connector component and deformation of the panel connector component comprises deformation of the pair of standoff hooked arms transversely apart from one another and then at least partial restoration of the pair of standoff hooked arms transversely toward one another.

12. A method for covering at least a portion of a surface of an existing structure with a repair structure, the method comprising:

connecting a plurality of longitudinally and transversely extending panels to one another in edge-adjacent relationship;

connecting a plurality of standoffs to the panels such that the standoffs extend from the panels toward the existing structure;

introducing a curable material into a space between the panels and the existing structure, the curable material providing a repair structure cladded at least in part by the panels once cured;

wherein connecting the plurality of standoffs to the panels comprises, for each connection, connecting a panel connector component of a corresponding panel and a standoff connector component of a corresponding standoff, wherein connecting the panel and standoff connector components comprises deforming at least one of the panel connector component and the standoff connector component;

wherein connecting the panel and standoff connector components comprises exerting a force directed to create relative movement between the corresponding standoff and the corresponding panel in a direction generally orthogonal to the interior surface of the corresponding panel at the location of the panel connector component;

wherein connecting the panel and standoff connector components comprises:

providing each of the plurality of panel connector components with a pair of panel hooked arms which extend away from the interior surface of the panel and which curve back toward the interior surface of the panel at distal ends of the panel hooked arms to provide corresponding panel hook concavities;

providing each of the plurality of standoff connector components with a pair of standoff hooked arms which extend away from a shaft of the standoff and which curve back toward the shaft of the standoff at distal ends of the standoff hooked arms to provide corresponding standoff hook concavities; and for each connection, engaging at least one of the pair of panel hooked arms of the corresponding panel connector component with at least one of the pair of standoff hooked arms of the corresponding standoff connector component.

13. A method according to claim 12, wherein, for each connection, engaging at least one of the pair of panel hooked arms of the corresponding panel connector component with at least one of the pair of standoff hooked arms of the corresponding standoff connector component comprises extending the at least one of the pair of panel hooked arms into the standoff hook concavity of the at least one of the pair of standoff hooked arms to terminate therein and extending the at least one of the pair of standoff hooked arms into the panel hook concavity of the at least one of the pair of panel hooked arms to terminate therein.

14. A method according to claim 12 comprising shaping the standoff connector components to provide beveled standoff surfaces which extend transversely toward one another as the beveled standoff surface extend toward the shaft of the standoff and shaping the panel connector components to provide beveled panel surfaces which extend transversely toward one another as the beveled panel surfaces extend away from the interior surface of the panel.

15. A method according to claim 14 wherein, for each connection, exerting the force directed to create relative movement between the corresponding standoff and the corresponding panel in the direction generally orthogonal to the interior surface of the panel comprises abutting the beveled standoff surfaces against the beveled panel surfaces and thereby causing the deformation of at least one of the panel connector component and the standoff connector component.

16. A method according to claim 14 wherein shaping the standoff connector components to provide the beveled standoff surfaces comprises shaping the standoff hooked arms to provide the beveled standoff surfaces and wherein shaping the panel connector components to provide the beveled panel surfaces comprises shaping the panel hooked arms to provide the beveled panel surfaces.

17. A method according to claim 12 comprising extending the standoffs into the space into which the curable material is introduced prior to the introduction of curable material, such that the standoffs anchor the panels to the curable material as it cures to thereby provide the cladding.

18. A method according to claim 12 wherein, for each connection, deforming at least one of the panel connector component and the standoff connector component comprises creating restorative deformation forces that prevent relative movement between the panels and the standoff under the force of gravity.

19. A method for covering at least a portion of a surface of an existing structure with a repair structure, the method comprising:

connecting a plurality of longitudinally and transversely extending panels to one another in edge-adjacent relationship;

connecting a plurality of standoffs to the panels such that the standoffs extend from the panels toward the existing structure;

introducing a curable material into a space between the panels and the existing structure, the curable material providing a repair structure cladded at least in part by the panels once cured;

wherein connecting the plurality of standoffs to the panels comprises, for each connection, connecting a panel connector component of a corresponding panel and a standoff connector component of a corresponding standoff, wherein connecting the panel and standoff connector components comprises deforming at least one of the panel connector component and the standoff connector component;

wherein connecting the panel and standoff connector components comprises exerting a force directed to create relative movement between the corresponding standoff and the corresponding panel in a direction generally orthogonal to the interior surface of the corresponding panel at the location of the panel connector component;

wherein connecting the panel and standoff connector components comprises:

providing each of the plurality of panel connector components with a pair of panel hooked arms which extend away from the interior surface of the panel and which curve back toward the interior surface of the panel at distal ends of the panel hooked arms to provide corresponding panel hook concavities;

providing each of the plurality of standoff connector components with a pair of standoff hooked arms which extend away from a shaft of the standoff and which curve back toward the shaft of the standoff at distal ends of the standoff hooked arms to provide corresponding standoff hook concavities;

for each connection, engaging at least one of the pair of panel hooked arms of the corresponding panel connector component with at least one of the pair of standoff hooked arms of the corresponding standoff connector component; and for each panel connector component, shaping the pair of panel hooked arms to be transversely spaced apart from one another and wherein, for each connection, deforming at least one of the panel connector component and the standoff connector component comprises deforming the panel connector component and deforming the panel connector component comprises deforming the pair of panel hooked arms transversely toward one another and then allowing at least partial restoration of the pair of panel hooked arms transversely away from one another.

20. A method for covering at least a portion of a surface of an existing structure with a repair structure, the method comprising:

connecting a plurality of longitudinally and transversely extending panels to one another in edge-adjacent relationship;

connecting a plurality of standoffs to the panels such that the standoffs extend from the panels toward the existing structure;

introducing a curable material into a space between the panels and the existing structure, the curable material providing a repair structure cladded at least in part by the panels once cured;

wherein connecting the plurality of standoffs to the panels comprises, for each connection, connecting a panel connector component of a corresponding panel and a standoff connector component of a corresponding standoff, wherein connecting the panel and standoff connector components comprises deforming at least one of the panel connector component and the standoff connector component;

wherein connecting the panel and standoff connector components comprises exerting a force directed to create relative movement between the corresponding standoff and the corresponding panel in a direction generally orthogonal to the interior surface of the corresponding panel at the location of the panel connector component;

wherein connecting the panel and standoff connector components comprises:

providing each of the plurality of panel connector components with a pair of panel hooked arms which extend away from the interior surface of the panel and which curve back toward the interior surface of the panel at distal ends of the panel hooked arms to provide corresponding panel hook concavities;

providing each of the plurality of standoff connector components with a pair of standoff hooked arms which extend away from a shaft of the standoff and which curve back toward the shaft of the standoff at distal ends of the standoff hooked arms to provide corresponding standoff hook concavities;

for each connection, engaging at least one of the pair of panel hooked arms of the corresponding panel connector component with at least one of the pair of standoff hooked arms of the corresponding standoff connector component; and for each standoff connector component, shaping the pair of standoff hooked arms to be transversely spaced apart from one another and wherein, for each connection, deforming at least one of the panel connector component and the standoff connector component comprises deforming the standoff connector component and deforming the standoff connector component comprises deforming the pair of standoff hooked arms transversely apart from one another and then allowing at least partial restoration of the pair of standoff hooked arms transversely toward one another.

* * * * *